US008556254B2

(12) United States Patent
Sakoguchi et al.

(10) Patent No.: US 8,556,254 B2
(45) Date of Patent: Oct. 15, 2013

(54) PAPER SHEET HANDLING APPARATUS

(75) Inventors: Yoshitaka Sakoguchi, Yokohama (JP); Kazuhiro Mukai, Yokohama (JP); Hisashi Oosawa, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/233,689

(22) Filed: Sep. 15, 2011

(65) Prior Publication Data

US 2012/0235351 A1 Sep. 20, 2012

(30) Foreign Application Priority Data

Mar. 18, 2011 (JP) ..... 2011-061556

(51) Int. Cl.
*B65H 1/06* (2006.01)

(52) U.S. Cl.
USPC ..... 271/165; 271/265.01

(58) Field of Classification Search
USPC ..... 271/3.08, 23, 35, 131–135, 162, 165, 271/166, 265.01, 298; 209/534; 902/15, 16; 194/206, 207
See application file for complete search history.

(56) References Cited

U.S. PATENT DOCUMENTS

| | | | | |
|---|---|---|---|---|
| 4,697,071 | A * | 9/1987 | Hiraoka et al. | 235/379 |
| 5,012,932 | A * | 5/1991 | Omura et al. | 209/534 |
| 5,430,664 | A * | 7/1995 | Cargill et al. | 194/207 |
| 6,260,840 | B1 * | 7/2001 | Suga et al. | 271/10.12 |
| 6,328,166 | B1 * | 12/2001 | Sakai | 209/534 |
| 6,550,221 | B1 * | 4/2003 | Neri | 53/399 |
| 8,256,604 | B2 * | 9/2012 | Ohishi | 194/206 |
| 2007/0063429 | A1 * | 3/2007 | Kang | 271/264 |
| 2010/0117294 | A1 * | 5/2010 | Maekawa et al. | 271/265.01 |

FOREIGN PATENT DOCUMENTS

| | | |
|---|---|---|
| EP | 0136936 | 9/1984 |
| JP | 04-137093 | 5/1992 |
| JP | 2686068 | 8/1997 |
| JP | 2001158403 | 6/2001 |
| KR | 19910009118 | 10/1991 |
| RU | 2133981 | 7/1999 |
| RU | 2144697 | 1/2000 |
| RU | 2369539 | 10/2009 |
| WO | 2008064295 | 5/2008 |

OTHER PUBLICATIONS

Patent Office of the Russian Federation Office Action dated Nov. 22, 2012.
Korean Intellectual Property Office Office Action dated Feb. 20, 2013.

* cited by examiner

*Primary Examiner* — Jeremy R Severson
(74) *Attorney, Agent, or Firm* — Baker Botts L.L.P.

(57) ABSTRACT

According to one embodiment, a paper sheet handling apparatus includes a supply unit including a support surface which tilts from a vertical direction, and a mounting surface substantially perpendicular to the support surface, and configured to receive a plurality of paper sheets which tilt along the support surface and are stacked on the mounting surface, a pick up mechanism configured to pick up the paper sheets from a mounting surface side of the supply unit, a conveyance path configured to convey the picked up paper sheet, an inspection device configured to inspect the conveyed paper sheet, and an accumulation unit configured to accumulate the inspected paper sheets.

13 Claims, 18 Drawing Sheets

PAPER SHEET HANDLING APPARATUS

CROSS-REFERENCE TO RELATED APPLICATIONS

This application is based upon and claims the benefit of priority from prior Japanese Patent Application No. 2011-061556, filed Mar. 18, 2011, the entire contents of which are incorporated herein by reference.

FIELD

An embodiment described herein relates generally to a paper sheet handling apparatus which handles paper sheets such as bills and securities.

BACKGROUND

In recent years, a large amount of bills have been handled in banks, large-scale retailers and the like on a daily basis, and a business has been present which classifies and arranges these bills in accordance with money types and wearing states (degrees of damage of the bills). Usually, when the amount of the bills increases, the bills are managed in a state where they are bound with a bundling tape every 100 bills. Therefore, as an apparatus which automates such an arrangement business of the bills, a bill arrangement apparatus has been suggested. This bill handling apparatus includes a hopper section which stacks and receives unclassified bills, a conveyance mechanism which picks up and conveys the bills one by one from this hopper section, an inspecting section which inspects types and damage degrees of the conveyed bills, a plurality of pocket sections which classify and accumulate the inspected bills in accordance with the money types or the like, and a strapping section which binds the accumulated bills every 100 bills with the tape or paper band.

For example, in financial institutions and the like, there has broadly prevailed an automatic teller machine (hereinafter referred to as the ATM) which enables customers to automatically perform the payment, remittance and the like of transaction mediums such as the bills and coins, and the number of the installed machines keeps on increasing. The ATM includes a loading storage such as an ATM cassette or a loading cassette which receives the bills as the transaction mediums, and through this loading storage, the bills are paid to the customers, or the bills deposited by the customers are accumulated in the loading storage. It is necessary to resupply and collect the bills to and from such an ATM in accordance with a use situation thereof. Therefore, there has been suggested a cash handling system including a loading storage having a function of automatically resupplying and collecting the bills to and from a plurality of ATMs.

In the above cash handling system, it is necessary to newly prepare the loading storage to be exclusively used for the resupply and the collection of the bills, which increases cost. Moreover, it is necessary to provide a space where the loading storage is disposed in each ATM, which enlarges the ATM.

Moreover, for the hopper section, there has been suggested a device which vertically stacks and picks up about 1000 paper sheets at maximum at a time. However, when the 1000 or more paper sheets are stacked, a frictional force between the paper sheets increases owing to the gravity of the stacked paper sheets. In consequence, when the paper sheets are taken out of the hopper section, a separation force is defeated by the frictional force at the time of the pick up, so that the paper sheets cannot stably be taken out. That is, there take place the slippage of the paper sheets, the pick up of double sheets, the dragging of the sheets, and the like. Furthermore, the coins or foreign matters are carried together with the taken paper sheets sometimes. If these matters are conveyed to the inspecting section, the inspecting section might break down.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

FIGS. 15A and 153 are plan views showing a regulation mechanism of the strapping module in the bill handling apparatus, respectively;

DETAILED DESCRIPTION

Various embodiments will be described hereinafter with reference to the accompanying drawings. In general, according to one embodiment, a paper sheet handling apparatus comprises:

a supply unit comprising a support surface which tilts from a vertical direction, and a mounting surface substantially perpendicular to the support surface, and configured to receive a plurality of paper sheets which tilt along the support surface and are stacked on the mounting surface;

a pick up mechanism configured to pick up the paper sheets from a mounting surface side of the supply unit;

a conveyance path configured to convey the picked up paper sheet;

an inspection device configured to inspect the conveyed paper sheet; and an accumulation unit configured to accumulate the inspected paper sheets.

Figure 1:
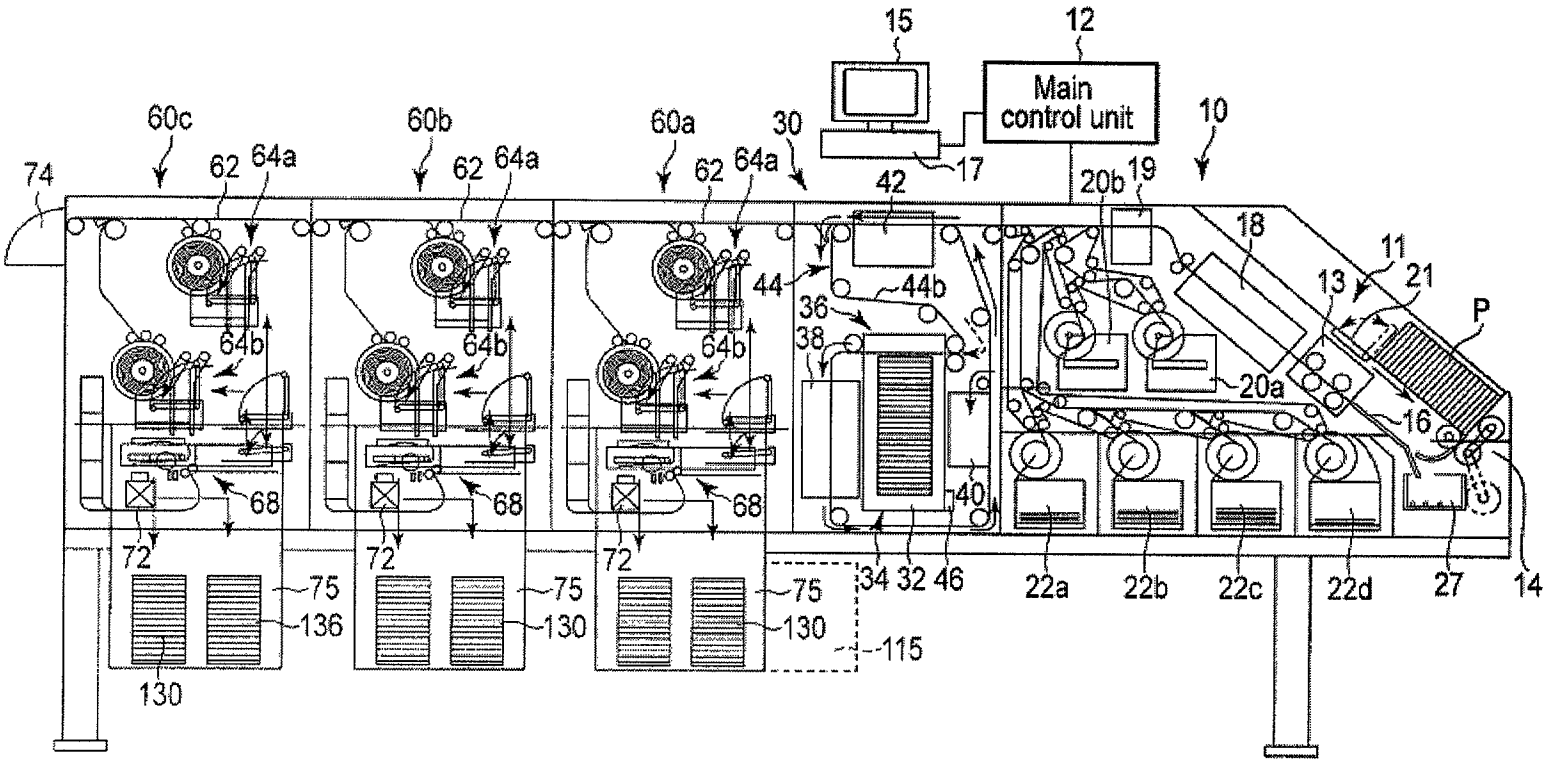
FIG. 1 is a sectional view showing a bill handling apparatus according to a first embodiment.
Figure 2:
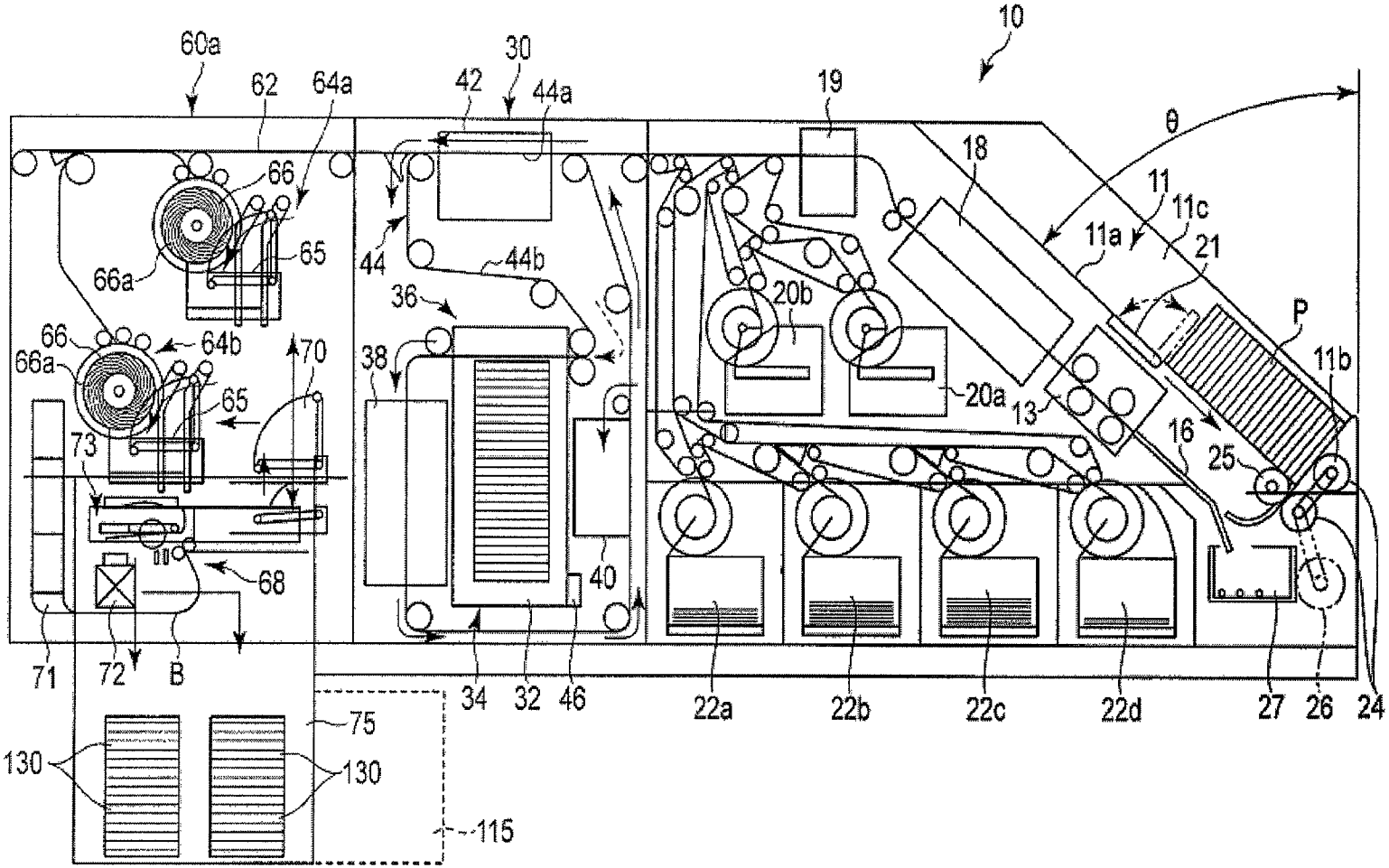
FIG. 2 is an enlarged sectional view showing a main module, a loading module, and a strapping module of the bill handling apparatus.

FIG. 1 is a sectional view schematically showing the whole constitution of a bill handling apparatus according to a first embodiment, and FIG. 2 is an enlarged sectional view showing a main module, a loading module, and a strapping module of the bill handling apparatus.

As shown in FIG. 1, the bill handling apparatus which handles bills as paper sheets includes a main module 10, a loading module 30, and three strapping modules 60*a*, 60*b* and 60*c*. These modules are arranged in a row in this order, and electrically and mechanically interconnected to one another. The main module 10 is provided with a main control unit 12 which controls an operation of the whole apparatus including this main module.

Figure 3:
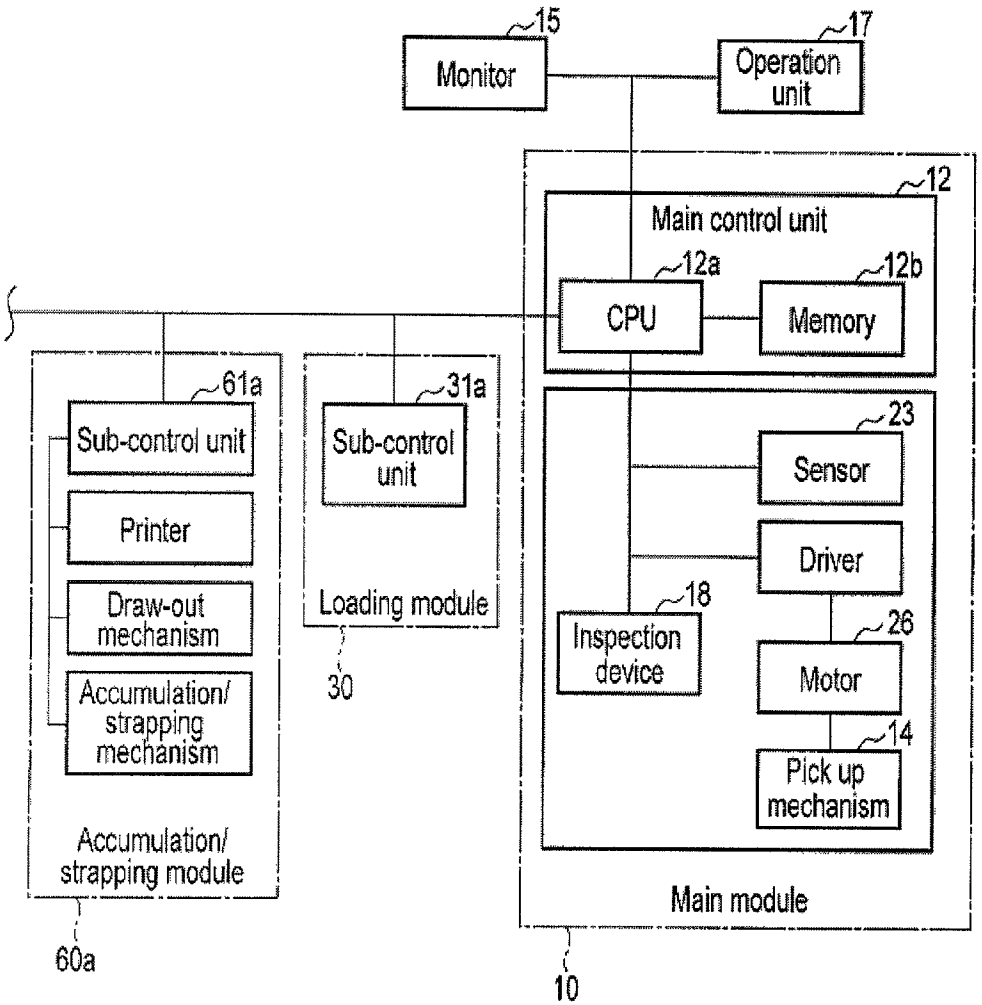
FIG. 3 is a block diagram schematically showing the bill handling apparatus.

As shown in FIG. 1 and FIG. 3, the main control unit 12 is provided in a control board of the main module 10. The main control unit 12 includes a CPU 12*a* which controls the operations of the respective modules and calculates an efficiency of an operation state and the like, and a memory 12*b* which stores various data, control programs, management information and the like. As the various data, there are stored, in the memory 12*b*, printing information printable on a bundling tape and including an operator ID, a date/time, a serial number, assignment information, a bank logo, a manager signature image, each country language font and the like which will be described later, processing speeds of a plurality of steps of paper sheets, and the like.

The main control unit 12 is connected to an operation unit 17 which inputs various pieces of information into the apparatus, and a monitor 15 as a display device which displays input information, an operation state and a processing state of the apparatus and the like. The loading module 30 and the three strapping modules 60*a*, 60*b* and 60*c* include sub-control units 31*a* and 61*a* which control the operations of the modules, respectively, and these sub-control units are LAN-connected to the main control unit 12 of the main module 10 via an interface and a cable (not shown). The main control unit 12 is connected to a host computer (not shown), transmits and receives the information to and from the host computer, and performs information organization.

By an operator's operation through the operation unit 17 connected to the main control unit 12, there are performed various operation settings of the handling apparatus, for example, the setting of a transaction method such as a deposit operation or an organization operation, the setting of loading processing into a loading storage, inspection processing of the bills in the loading storage and an accumulation storage to store handled paper sheets P, the setting of strapping processing, the setting of a wearing level which is a bill judgment level and the like.

Moreover, the main control unit 12 calculates the management information including a processing efficiency of a unit time, a processing efficiency of each of a plurality of days, a processing efficiency of each operator ID, a total number of the handled sheets and a total operation time in accordance with processing information from an inspection device 18, and the main control unit stores the information in the memory 12*b*, and displays the information in the monitor 15.

As shown in FIG. 1 and FIG. 2, the main module 10 includes a supply unit 11 in which a large number of bills P are mounted in a stacked state, a pick up mechanism 14 which picks up the bills P one by one from the supply unit 11, and a conveyance path 16 along which the bills P taken out by the pick up mechanism 14 are conveyed. In the conveyance path 16, a plurality of sets of endless conveyance belts (not shown) are extended to hold the conveyance path. The taken bills P are held and conveyed by the conveyance belts.

Figure 4:
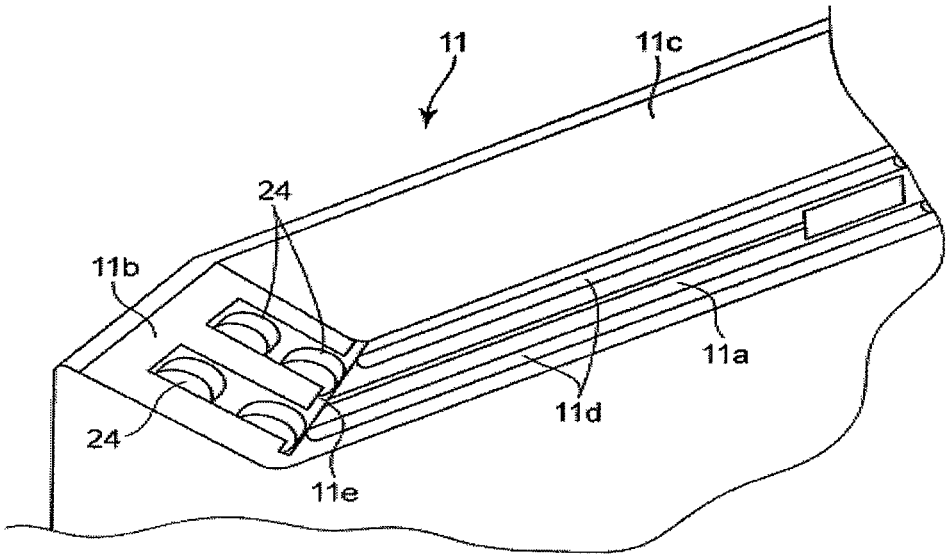
FIG. 4 is a perspective view showing a supply section of the bill handling apparatus.
Figure 5:
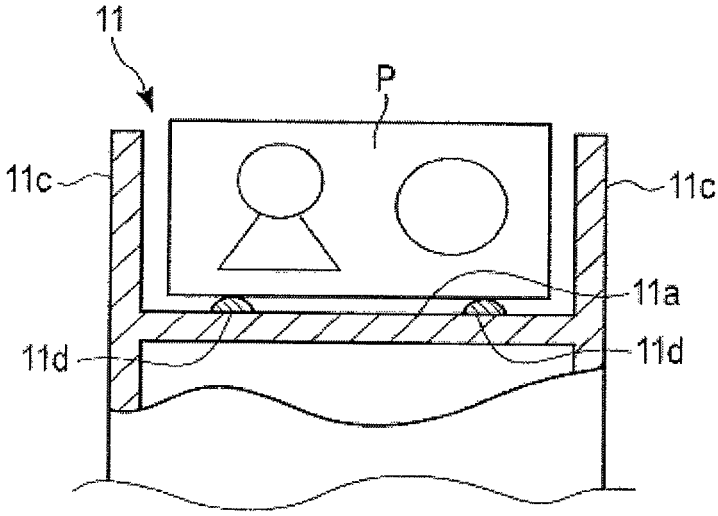
FIG. 5 is a sectional view of the supply section.

As shown in FIG. 2, FIG. 4 and FIG. 5, the supply unit 11 includes a support surface 11*a* which tilts as much as an angle θ from a vertical direction and extends, a mounting surface 11*b* which extends from a lower end of the support surface 11*a* in a direction which is substantially orthogonal to the support surface 11*a*, and a pair of guide walls 11*c* vertically disposed along both side edges of the support surface 11*a* and the mounting surface 11*b*. In a boundary portion between the support surface 11*a* and the mounting surface 11*b*, a pick up port 11*e* is formed to take the bills P in the apparatus. The supply unit 11 is provided on an end side of the main module 10 in an apparatus main body, and further the lower portion of the supply unit 11, i.e., the mounting surface 11*b* is positioned in the vicinity of the lower end of the apparatus main body.

In the supply unit 11, a plurality of, for example, 2000 or more bills P can be mounted in the stacked state. In the stacked bills P, the lowermost bill is mounted on the mounting surface 11*b*, and for example, in a state where long-side edges of the bills are mounted on the support surface 11*a*, the bills tilt along the support surface, and are mounted in the supply unit 11. The stacked bills P are taken in the apparatus through the pick up port 11*e* one by one in order from the lowermost bill P by the pick up mechanism 14.

The tilt angle θ of the support surface 11*a* is set to, for example, a range of 30 to 40 degrees in a range of 25 to 75 degrees. It is to be noted that the support surface 11*a* is disposed rotatably with respect to the apparatus main body, and the tilt angle θ of the surface may be regulated.

Figure 6A:
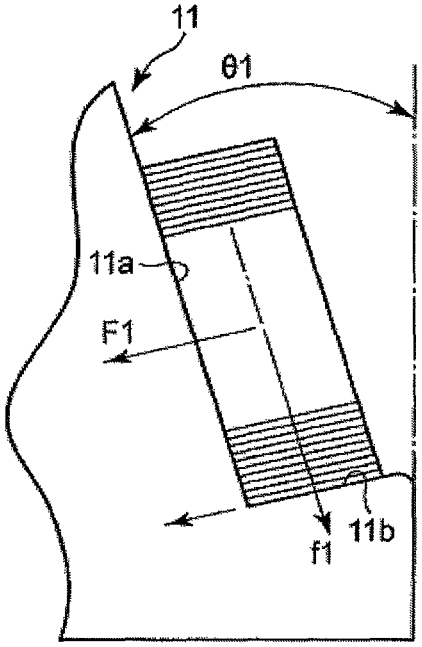
FIGS. 6A and 6B are diagrams schematically showing the supply section whose support surface has different tilt angles.
Figure 6B:
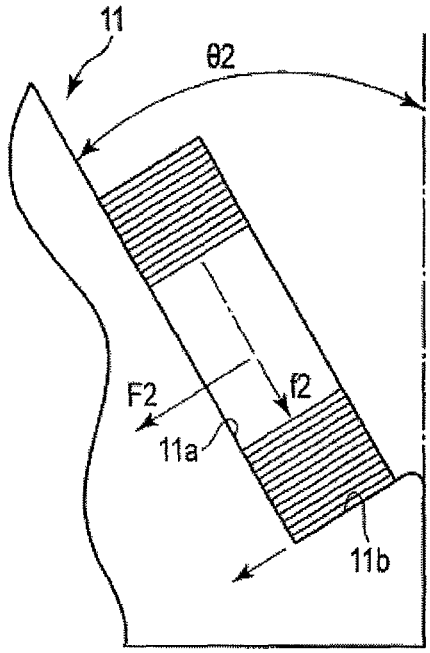

FIG. 6A shows a case where the support surface 11*a* tilts as much as an angle θ1=20 degrees from the vertical direction, and FIG. 6B shows a case where the support surface 11*a* tilts as much as an angle θ2=30 degrees. When the tilt angle of the support surface 11*a* is increased to decrease a pick up angle of the bills P, a weight of the stacked bills P to be added to the mounting surface 11*b* decreases (f1>f2), and friction among the bills P along a stacking direction lowers. In consequence, even when about 2000 bills P are stacked and arranged in the supply unit 11, the bills P can stably be taken out.

On the other hand, when the tilt angle of the support surface 11*a* is increased to decrease the pick up angle of the bills P, the weight of the bills P to be added to the support surface 11*a* increases (F1<F2), and the friction between the side edge of each bill P and the support surface 11*a* increases. This degree of the increase of the added weight has only little influence on the pick up of the bills P. In the present embodiment, however, to further lower the friction, as shown in FIG. 4 and FIG. 5, a pair of ribs 11*d* are projected from the support surface 11*a*. The ribs 11*d* extend in parallel with each other along a longitudinal direction of the support surface 11*a*, i.e., the stacking direction of the bills P. The side edges of the stacked bills P mounted on the supply unit 11 are mounted on the pair of ribs 11*d*. Therefore, a contact area between each bill P and the support surface 11*a* becomes small, which can lower the friction therebetween. In consequence, when the stacked bills P are taken out in order from the lowermost bill P, the bills successively and smoothly lower to the side of the mounting surface 11*b*.

As shown in FIG. 2, the supply unit 11 includes a backup plate 21 which moves the stacked bills P toward the pick up side, i.e., the mounting surface 11*b*. The backup plate 21 is provided storably on the support surface 11*a* and movably along the support surface. The backup plate 21 is rotatably supported by the support surface 11*a*. Usually, when, for example, about 2000 bills P are mounted on the supply unit 11, the backup plate 21 is rotated to a position which becomes about the same surface as the support surface 11*a*, and held at the position by a torsional spring or the like. When the pick up of the bills P advances and the number of the bills decreases to, for example, about 800 bills, the backup plate 21 is rotated to a position where the plate is raised from the support surface 11*a* at right angles, and then the plate abuts on the uppermost bill of the stacked bills P to move to the pick up side together with the stacked bills P. In consequence, the backup plate 21 can move the stacked bills P to the pick up side, and even in a state where the number of the stacked bills P decreases, the falling of the bills or the like is prevented, and the bills can stably be moved to a pick up position.

Figure 7:
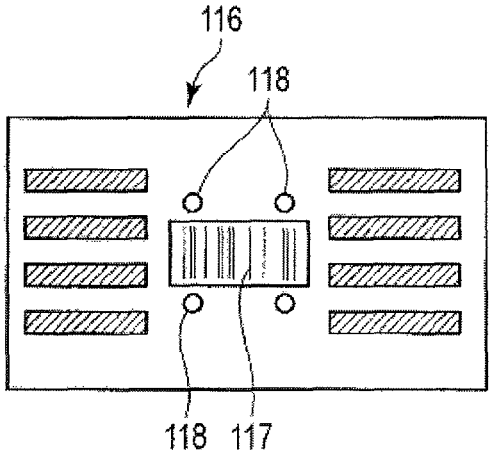
FIG. 7 is a plan view showing a batch card for use in the bill handling apparatus.

It is to be noted that the paper sheets mounted on the supply unit 11 may include a batch card 116 as shown in FIG. 7. The batch card 116 is formed into the same outer diameter dimension as the bill P, or an outer diameter dimension which is larger than the bill P, and on the front surface and/or the back surface of the batch card, a barcode 117 indicating information of a batch of bills P is formed. Moreover, the batch card has a plurality of detection holes 118. Furthermore, the batch card is formed in a color such as red, blue or green. The batch card 116 is mounted on the supply unit 11 in a state in which the card is stacked on the top or the backmost end of an arbitrary batch of the stacked bills P.

Figure 8:
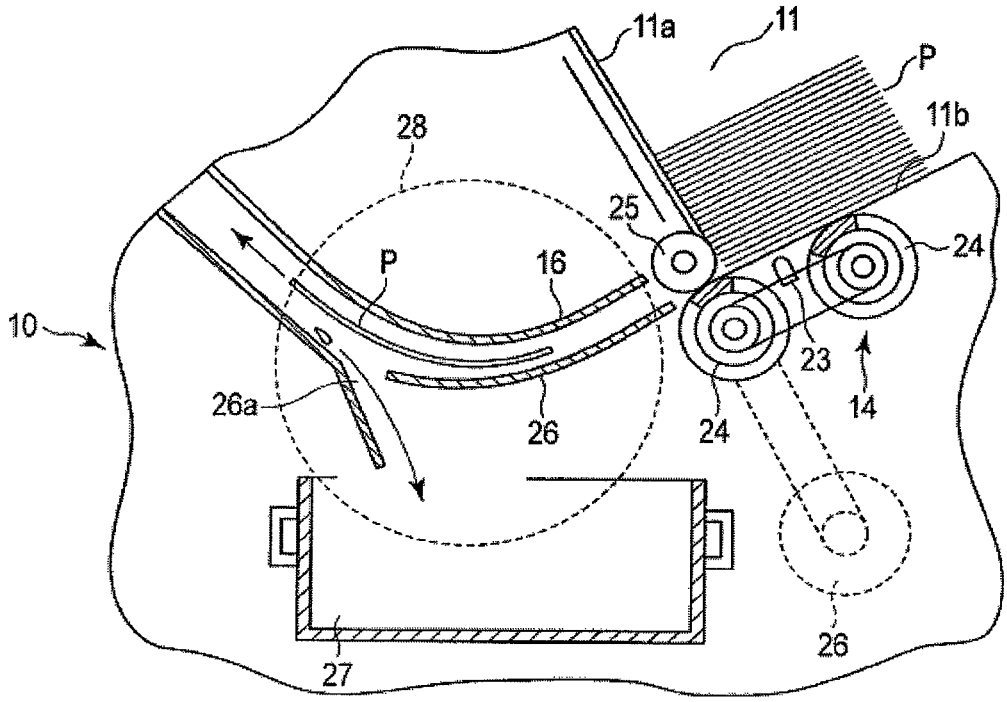
FIG. 8 is an enlarged sectional view showing a pick up mechanism and a conveyance path in the bill handling apparatus.

As shown in FIG. 2 and FIG. 8, the pick up mechanism 14 which picks up the bills P one by one from the supply unit 11 includes a plurality of pickup rollers (pick up rollers) 24 provided so that the rollers can abut on the bills P on the mounting surface 11*b*, a separation roller 25 provided to rotatably come in contact with the pickup roller 24 on the side of the pick up port 11*e*, and a driving motor 26 which rotates the pickup rollers 24 at a predetermined speed.

When the pickup rollers 24 rotate, the lowermost bill P is taken out by the pickup rollers 24, and fed through the pick up port 11*e* to the conveyance path 16. In this case, by the separation roller 25, the second and following bills P are separated from the taken bill. In consequence, the bills P are, one by one, taken out of the supply unit 11 and fed to the conveyance path 16.

The main control unit 12 regulates a bill take-in amount and take-in speed of the pick up mechanism 14 in a plurality of steps in accordance with the mounted amount of the stacked bills P or an input instruction from the operator. That is, the main control unit 12 regulates the rotation speed of the pickup rollers 24 by the driving motor 26, to set the take-in amount to, for example, 1000 bills, 800 bills or 600 bills per minute. Moreover, the main control unit 12 regulates the take-in amount of the bills P in accordance with an inspection state of the inspection device 18 described later. For example, when the inspection device 18 does not satisfactorily inspect the bills P, the main control unit 12 decreases the take-in amount from 1000 bills per minute to 800 bills per minute. Furthermore, when the inspection device 18 detects the pick up of double sheets or a short pitch of the bills P, the main control unit 12 temporarily stops or reverses the pickup rollers 24, to prevent the pick up of double sheets of the bills P and normalize a feed pitch of the bills P.

It is to be noted that in the vicinity of the pick up port 11*e*, a sensor (not shown) which detects the presence/absence of the bills P on the mounting surface 11*b*. When the batch card 116 is used, an RGB sensor 23 is provided to face the mounting surface 11*b* as shown in FIG. 8. The RGB sensor 23 detects the color of the paper sheets, to detect the batch card 116.

As shown in FIG. 1 and FIG. 2, a conveyance pitch correcting section 13 which corrects the conveyance pitch of the bills P conveyed through the conveyance path 16, the inspection device 18 which inspects, one by one, the bills P having the corrected conveyance pitch and a barcode reader 19 are arranged along the conveyance path 16. The inspection device 18 is disposed above the pick up port 11*e* of the supply unit 11 in the vertical direction. The inspection device 18 detects money types, shapes, thicknesses, fronts/backs, authenticities, wearing states, the pick up of double sheets and the like of the conveyed bills P. Here, the wear detection indicates the detection of new notes which can be re-circulated and worn notes which have dirt, damage and the like and cannot be re-circulated. For example, when the batch card 116 is used, the barcode reader 19 reads the barcode 117 attached to the batch card 116 which has passed through the inspection device 18, and sends the read information to the main control unit 12. It is to be noted that any independent barcode reader is not provided but a constitution may be provided in which the inspection device 18 reads the barcode.

The conveyance path 16 once extends downwardly from the pick up mechanism 14 and the pick up port 11*e*, obliquely tilts from the vertical direction, and then extends upwardly from the downside to the inspection device 18. According to the present embodiment, the conveyance path 16 tilts and extends substantially along the support surface 11*a* of the supply unit 11, i.e., in the same manner as in the support surface 11*a*. It is to be noted that the conveyance path 16 may not once lower from the pick up port 11*e* but may immediately extend obliquely upwardly from the pick up port. Moreover, the inspection device 18 also obliquely tilts and is provided along the conveyance path 16.

The conveyance path 16 is tilted and extended from the downside to the upside in this manner, whereby when foreign matters such as clips, coins or pins are picked together with the bills P from the supply unit 11 in the conveyance path 16, the foreign matters drop down along the conveyance path 16 to the lowermost portion of the conveyance path owing to gravity. In consequence, the foreign matters are removed before entering the inspection device 18, and the damage of the inspection device 18 due to the foreign matters can be prevented in advance.

As shown in FIG. 2 and FIG. 8, a discharge port 26*a* is formed in a guide plate 26 which defines the conveyance path 16 in the lowermost portion of the conveyance path 16, and further under the discharge port 26*a*, a foreign matters collecting unit is provided. The foreign matters collecting unit is constituted of, for example, a collection box 27 which can be drawn out of the apparatus main body. The foreign matters which drop down along the conveyance path 16 are discharged through the discharge port 26*a*, and collected in the collection box 27.

Figure 9:
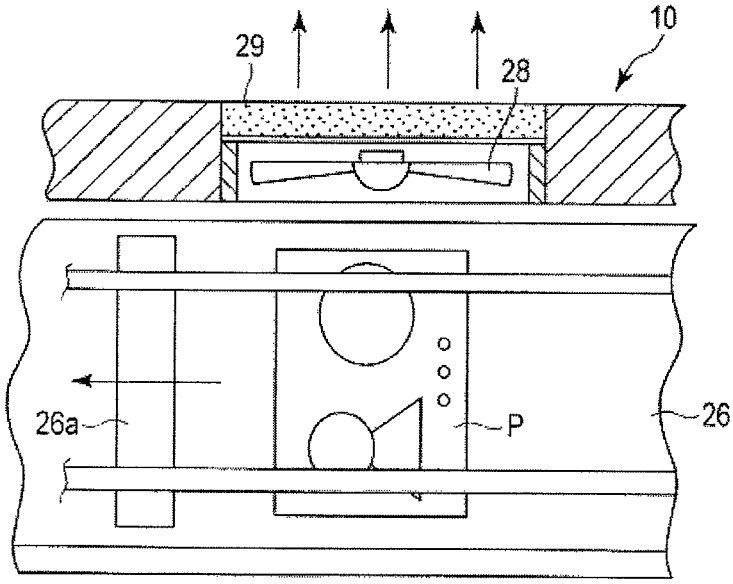
FIG. 9 is a sectional view showing the lowermost portion of the conveyance path and a suction fan.

As shown in FIG. 8 and FIG. 9, a suction fan 28 is provided to face the lowermost portion of the conveyance path 16, and further on an exhaust side of the suction fan 28, a dust collection filter 29 is provided. The suction fan 28 sucks air through the lowermost portion of the conveyance path 16, to remove, from the conveyance path 16, paper powder, powder dust and the like generated in the conveyance path, thereby collecting the powder through the dust collection filter 29. This prevents the pollution of the conveyance path 16 due to the paper powder or the like, and the deterioration of inspection accuracy in the inspection device 18.

As shown in FIG. 1 and FIG. 2, in the main module 10, two rejecting sections 20*a* and 20*b* are provided along the conveyance path 16, and a plurality of accumulation storages 22*a*, 22*b*, 22*c* and 22*d* in which the bills are accumulated, respectively, are arranged side by side. The bills P which have passed through the inspection device 18 are sorted into rejected notes and processed notes by a gate (not shown). The rejected notes are notes judged to be false notes, or notes judged to be notes which cannot be identified owing to fold, break, skew, the pick up of double sheets, or the like, by the inspection device 18. The skew is a state where the bill P obliquely tilts from a direction which is orthogonal to a conveyance direction. The rejected notes are sorted into the rejecting section 20*a* or 20*b*, and accumulated. The rejected notes accumulated in the rejecting section 20*a* or 20*b*, except false notes, are set again in the supply unit 11 and taken in the apparatus again, or counted in count data by manual input. Inspection results such as a processed money amount and the number of sheets by the inspection device 18 are sent to the main control unit 12 and stored, and displayed in the monitor 15.

Moreover, the processed notes indicate that the bills P are judged to be true and new notes or true and worn notes by the inspection device 18. The processed notes are fed to and accumulated in the accumulation storages 22*a* to 22*d*. For example, the processed notes of each money type are sorted and accumulated in any of the accumulation storages 22*a* to 22*d*, and the worn notes are collectively accumulated in one accumulation storage.

When the batch card 116 is used, the batch card 116 passes through the inspection device 18 and the barcode reader 19, and is then fed to and accumulated in the rejecting section 20*a* or 20*b*.

The conveyance path 16 is connected to the loading module 30 described later. When the loading module 30 loads the bills in the loading storage, part or all of the processed notes inspected by the inspection device 18 of the main module 10 are conveyed to the loading module 30 through the conveyance path 16.

It is to be noted that the main module 10 includes a driving mechanism and a power source (not shown) to drive the pick up mechanism 14, the inspection device 18, a conveyance mechanism and the like, and additionally includes various sensors.

As shown in FIG. 1 and FIG. 2, the loading module 30 includes an attaching section 34 to which a loading storage 32 such as an ATM cassette taken out of the automatic teller machine (ATM) or a loading cassette is detachably attached, a loading/pick up mechanism 36 which loads the bills in the loading storage 32 or picks up the bills from the loading storage 32, an inspection device 38, a rejection storage 40, an alignment mechanism 42, and a conveyance path 44 which conveys the bills through these parts. In the conveyance path 44, a plurality of sets of endless conveyance belts are extended to hold the conveyance path. The bills are held and conveyed by the conveyance belts. The conveyance path 44 includes a first conveyance path 44*a* continuing from the conveyance path 16 of the main module 10 to the strapping module 60*a*, and a second conveyance path 44*b* which passes from the first conveyance path through the attaching section 34, the inspection device 38 and the vicinity of the rejection storage 40 to return to the first conveyance path.

As the loading storage 32 attached to the attaching section 34, there is attached a loading storage which enables only the loading of the bills (deposit), a loading storage which enables only the pick up of the bills (withdrawal) or a loading storage which enables the loading and pick up of the bills (deposit/withdrawal). Here, the loading storage 32 is configured to enable the loading of a large number of bills and the pick up of the bills from the loading storage. Moreover, the loading storage 32 includes a sensor which detects the loading and pick up of the bills, and a memory which stores information such as the note types of the loaded bills, the amount of money (the present amount), operator information, ID of the loading storage 32 (a branch number or an index indicating the corresponding loading storage), machine body number and the like.

FIG. 10 shows an example of the automatic teller machine (ATM). An ATM 31 includes a substantially rectangular box-like main body 200, and the front surface of the main body is provided with a substantially L-shaped service panel 202 which faces users. A horizontal part of the service panel 202 is provided with a display section 204 which also serves as a touch panel, and a vertical part of the panel is provided with a card insertion port 206, a passbook insertion port 208 and the like. Moreover, a corner part of the service panel 202 is provided with a bill deposit/withdrawal port 210 and a coin deposit/withdrawal port 212 which are opened and closed with doors, respectively.

In the main body 200, there are arranged a bill handling device 214 for the users to deposit and withdraw the bills through the bill deposit/withdrawal port 210, a coin handling device 216 to deposit and withdraw coins through the coin deposit/withdrawal port 212, a control unit 218, a passbook printer 220, a card/slip processing device 222 and the like.

The rear surface of the main body 200 is provided with an openable/closable door 224 which enables the pick up of the bill handling device 214 and the coin handling device 216 from the main body. In the door 224, an insertion port 226 is formed to face a bill carrying-in/out section of the bill handling device 214 described later, and the insertion port 226 is opened and closed with a vertically openable door 228. Moreover, the rear surface of the bill handling device 214 is provided with a connector 230 which faces the insertion port 226.

Figure 10A:
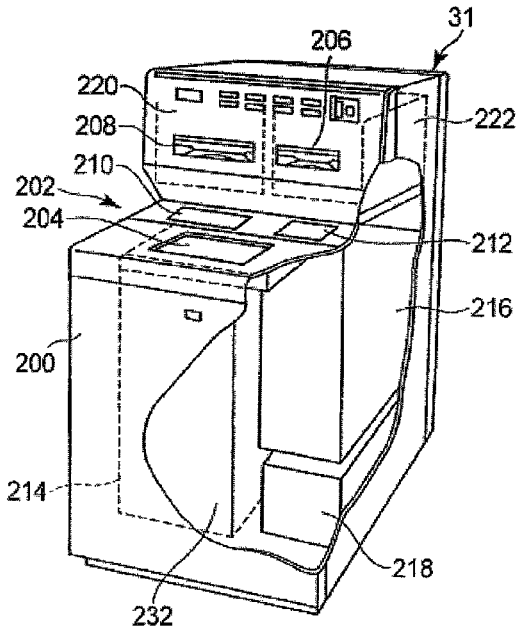
FIG. 10A is a perspective view showing a front side of an automatic teller machine.
Figure 10B:
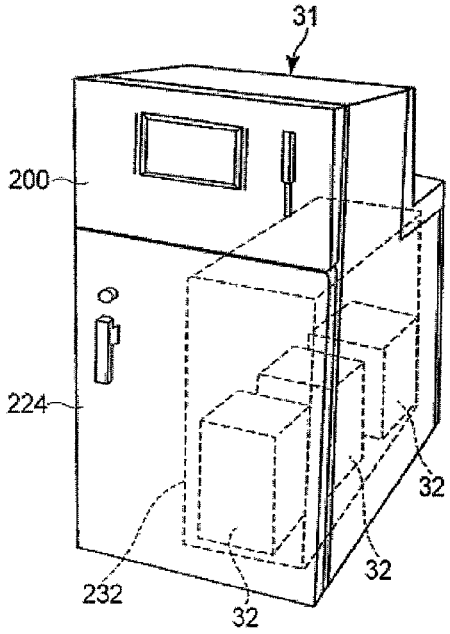
FIG. 10B is a perspective view showing a back side of the automatic teller machine.
Figure 11:
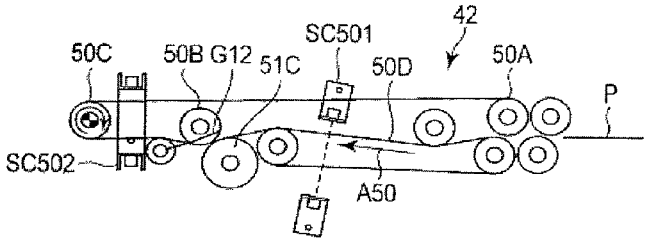
FIG. 11 is a side view showing an alignment mechanism of a loading module of the bill handling apparatus.
Figure 12:
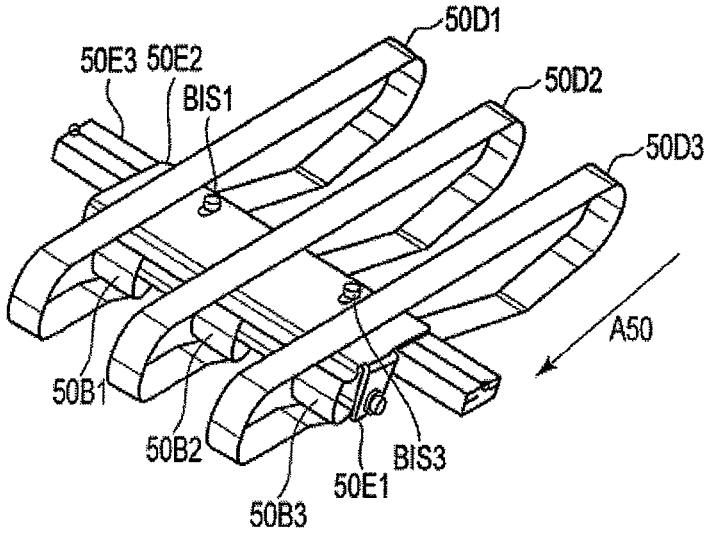
FIG. 12 is a perspective view showing the alignment mechanism.
Figure 13:
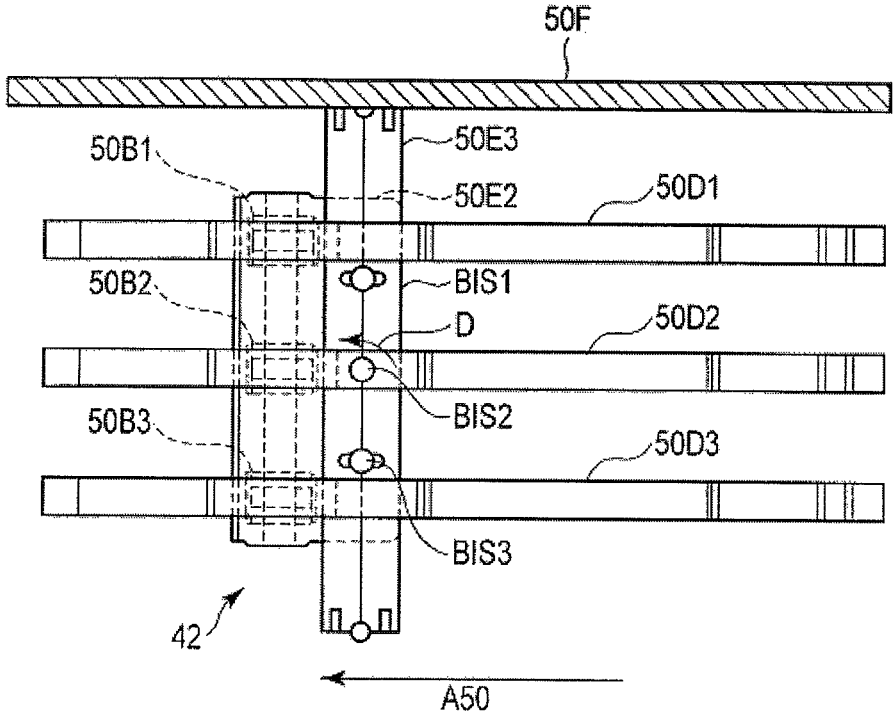
FIG. 13 is a plan view showing the alignment mechanism.

As shown in FIGS. 10A and 10B, the bill handling device 214 includes an elongated box-like housing 232, and in this housing, for example, two loading storages which receive ten thousand yen bills and a loading storage which receives one thousand yen bills are provided side by side as the loading storages 32. When the door 224 is opened to draw out the housing 232, the loading storages 32 can be removed from the housing 232 or can be attached to the inside of the housing 232. Additionally, the housing 232 is provided with a bill accumulating section which receives the bills introduced through the bill deposit/withdrawal port 210 and from which withdrawal bills are withdrawn, a deposit temporary accumulating section which temporarily accumulates the deposit bills, an inspecting section which inspects the deposit bills and the withdrawal bills, a pair of rejection storages which receive rejected bills, a collection storage which receives the worn notes, and the like.

As shown in FIG. 2, the loading storage 32 taken out of the ATM 31 is detachably attached to the attaching section 34 of the loading module 30. When the loading storage 32 is attached to the attaching section 34, the loading storage 32 is connected to the loading/pick up mechanism 36, and connected to the control unit of the loading module 30 via a connector 46. The information stored in the memory of the loading storage 32 is sent to the main control unit 12 via the connector 46 and LAN. To the loading storage 32, a radio frequency identification (RFID) such as a radio IC tag is assigned, and the information of the loading storage 32 may be sent to the loading module 30 and the main control unit 12 by radio communication.

The loading/pick up mechanism 36 of the loading module 30 includes a pick up roller which takes the bills one by one from the loading storage 32, a loading roller which loads the bills in the loading storage 32, a conveyance belt and the like.

The inspection device 38 detects the money types, shapes, thicknesses, front and back surfaces, authenticities, wearing states, the pick up of double sheets, bill serial numbers and the like of the bills taken out of the loading storage 32. Here, the detection of the wearing states indicates the detection of the new notes which can be re-circulated and the worn notes which have the dirt, damage and the like and cannot be re-circulated. The worn notes also include strapped bills. The authenticity detection can use, for example, magnetic detection, image detection, or fluorescence detection in which fluorescence is emitted to read reflected light. Moreover, the inspection device 38 counts the taken bills, to calculate the number of the bills and the present amount. Inspection results such as the present amount and the number of the bills detected by the inspection device 18 are sent to the main control unit 12, stored therein and displayed in the monitor 15.

The rejection storage 40 is provided on a downstream side of the inspection device 38 in the conveyance direction of the bills. The bills P which have passed through the inspection device 38 are sorted into the rejected notes and the processed notes by a gate (not shown). The rejected notes are the notes judged to be the false notes, or the notes judged to be the notes which cannot be identified owing to the fold, break, skew, the pick up of double sheets, and the like, by the inspection device 18. The rejected notes are fed to and accumulated in the rejection storage 40. Moreover, beforehand under the control of the main control unit 12, one or a plurality of the accumulation storages 22*a* to 22*d* of the main module 10 is set as the rejection storage, and the rejected note discharged from the loading module 30 may be fed to and accumulated in the rejection storage of the main module 10. Furthermore, among the rejected notes which have passed through the inspection device 38, the rejected notes judged to be the false notes and the other rejected notes may be divided and accumulated in separate rejection storages.

The processed notes are the bills P which are judged to be the true and new notes or the true and worn notes by the inspection device 38. The new notes are returned to the loading storage 32 through the conveyance path 44*b* and the alignment mechanism 42, and loaded in the loading storage 32 by the pick up/loading mechanism 36. Beforehand under the control of the main control unit 12, one or a plurality of the accumulation storages 22*a* to 22*d* of the main module 10 is set as a worn note storage, whereby the worn notes discharged from the loading module 30 are fed to and accumulated in the worn note storage of the main module 10.

As to the new notes taken out of the loading storage 32, the notes preset for each money type may be accumulated in the accumulation storages 22*a* to 22*d* of the main module 10 every arbitrarily designated number thereof. Moreover, when the number of the sheets to be accumulated in the loading storage 32, for example, 2000 sheets are set, a shortage can be recognized from the number of the new notes detected by the inspection device 38 as described above, whereby the bills to compensate for the shortage are supplied from the main module 10 to the loading module 30, and loaded in the loading storage 32 through the alignment mechanism 42 and the conveyance path 44. When the loading storage 32 is attached to the attaching section 34 of the loading module 30, the present amount of the bills in the loading storage 32 is automatically sent to the main control unit 12. Therefore, when the main control unit 12 judges that the sent present amount is smaller than the desirable present amount, the shortage bills may automatically be supplied to and loaded in the loading storage 32 from the main module 10.

The information of the bills loaded in the loading storage 32 from the main module 10 is stored in the memory of the loading storage 32, and electronically sealed. When the loading storage 32 is taken out of the loading module 30 and a 11*d* thereof is opened, door opening information and date/time are stored in the memory. As the electronic seal, a password or an IC card can be used. When the door of the loading storage 32 is opened, an electronic key or the IC card is used. In this case, the information of the operator using the key or the like is also stored in the memory. In consequence, security properties of the loading storage 32 can be enhanced.

Moreover, information obtained from the loading storage 32, for example, information such as ATM store number, the operator information, the note type, the amount of the money, a loading direction, the amount of the loaded bills and a transport route of the loading storage are sent to the main control unit 12, and recorded and totaled in the main control unit 12. The operator information includes an operator on the side of the ATM store, and an accepting operator who sets the loading storage 32 to the bill handling apparatus. When the information of the loading storage 32 is managed by the main control unit 12, the security properties can be enhanced.

On the other hand, when the strapping processing of the bills is set, the new notes taken out of the loading storage 32 are conveyed to the strapping module 60*a* through the conveyance path 44 and the alignment mechanism 42, and the notes are strapped every predetermined number thereof. The alignment mechanism 42 aligns the center of each bill conveyed through the conveyance path 44 with the center of the conveyance path, or corrects the skewed bills so as to direct one side of each bill orthogonally to the conveyance direction.

FIG. 11 to FIG. 14 show the alignment mechanism 42. As shown in these diagrams, the alignment mechanism 42 is constituted of a plurality of conveyance rollers arranged in a direction which is orthogonal to the conveyance path on upstream and downstream sides of the conveyance path to convey the bills P, and the conveyance belt is extended around the facing conveyance rollers. In the present embodiment, the alignment mechanism includes a plurality of conveyance rollers such as a conveyance roller 50A, a correction roller 50B and a conveyance roller 50C, conveyance belts 50D1 to 50D3 extended around these conveyance rollers, timing sensors SC501 and SC502, and a driving motor (not shown). The conveyance roller 50A is a take-in roller which takes the bills P in the alignment mechanism 42, and is constituted of three conveyance rollers (50A1 to 50A3) (not shown) corresponding to the conveyance belts 50D1 to 50D3. Here, these rollers are generically referred to as the conveyance roller 50A.

The correction roller 50B is a roller which corrects belt positions of the conveyance belts 50D1 to 50D3, and is constituted of three correction rollers 50B1 to 50B3 corresponding to the conveyance belts 50D1 to 50D3, and the rollers are idle rollers. Here, the rollers are generically referred to as the correction roller 50B.

The conveyance roller 50C is a driving roller which drives a conveyance belt 50D, and is constituted of three conveyance rollers (50C1 to 50C3) (not shown) corresponding to the conveyance belts 50D1 to 50D3. Here, the rollers are generically referred to as the conveyance roller 50C. This also applies to the other conveyance rollers.

These conveyance rollers are supported in a cantilever manner by a unit base 50F of the alignment mechanism 42, and the rollers disposed away from the unit base more easily bend. The alignment mechanism 42 includes the correction roller 50B, a rotary shaft around which the correction roller 50B is coaxially arranged, a base 50E2 which holds this rotary shaft, and a stay 50E3 which fixes the base 50E2 to the unit base 50F.

In the correction rollers 50B1 to 50B3, the center of the surface of each roller is formed into a crown shape having the center which is higher than both end portions (the shape having a diameter which becomes larger than a diameter of each end of the roller closer to the center of the roller). Moreover, the three correction rollers 50B1 to 50B3 are fixed to a rotary shaft including a bearing disposed around the same axis, and arranged to outwardly come in contact with the conveyance belts 50D1 to 50D3, respectively. Both ends of this rotary shaft are fixed to the base 50E2 by a holder 50E1.

Figure 14:
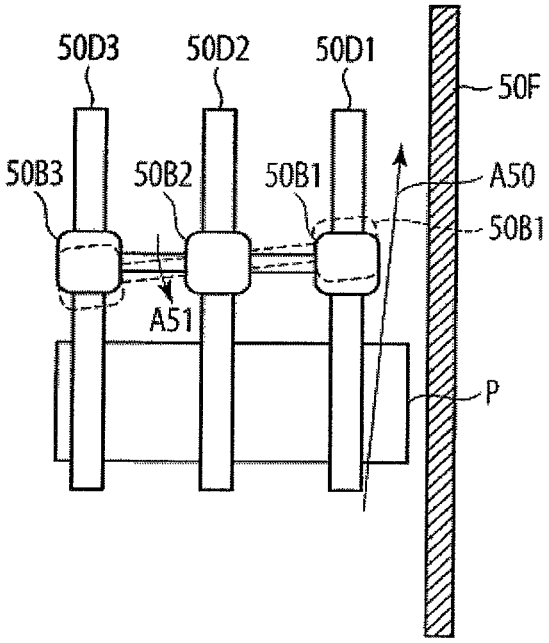
FIG. 14 is a plan view showing a bill alignment operation of the alignment mechanism.

The base 50E2 is fixed to the rod-like stay 50E3 projecting from the unit base 50F via screws BIS1 and BIS3. When a screw BIS2 which is a rotary shaft of the alignment mechanism 42 is rotated, the base 50E2 rotates around the screw BIS2 which is the rotary shaft, so that the positions of the correction rollers 50B1 to 5053 can be moved as shown in FIG. 14. In the embodiment, portions of the base 50E2 to which the screws BIS2 and BIS3 are attached are formed into long holes, in which a rotation range of the screw BIS2 is taken into consideration.

A method of aligning the conveyed bills P by the alignment mechanism 42 will be described. Since the conveyance rollers 50A to 50C are supported by the unit base 50F in the cantilever manner as described above, portions of the rollers disposed away from the unit base 50F more easily bend. Owing to the influence of this bend, the conveyance belt 50D meanders in a direction shown by an arrow A50, i.e., from a proximal side to a distal side (the side of the unit base 50F). With this meandering, the bills P held by the conveyance belt 50D similarly shift from the proximal side to the distal side. When the bills P having this state are accumulated in the loading storage 32, an accumulated state of the bills worsens.

To solve the problem, when the screw BIS2 is rotated in a (counterclockwise) direction shown by an arrow A51 in FIG. 14, the correction rollers 50B1 to 50B3 move to positions shown by broken lines. With this moving, conveyance belt positions of the conveyance belt 50D are corrected in an initial state. When the conveyance belt positions do not have any problem, the screws BIS1 and BIS3 are fixed at the positions. It is to be noted that a rotation amount of the screw BIS2 is preferably dynamically set while observing a conveyance state of the bills P.

When the screw BIS2 is rotated in the direction shown by the arrow A51 in the diagram, the roller center of the correction roller having the above crown shape is raised, and hence this raised roller center moves from the unit base 50F to the proximal side. It is known that the conveyance belt 50D moves toward this high position of the roller center, and on the basis of this principle, the conveyance belt 50D is corrected. In this case, the conveyance belt 50D1 is corrected from the unit base 50F side to the proximal side, and the conveyance belt 50D3 is similarly corrected from the proximal side to the unit base 50F side.

The alignment mechanism 42 has a major function of preventing the generation of bill sliding due to the belt meandering, and aligning the center of each bill with the center of the conveyance path. Moreover, when a plurality of modules are interconnected to lengthen the conveyance path, the bills gradually shift owing to the belt meandering during the conveyance. The alignment mechanism 42 corrects this bill shifting, to align the bills with the center of the conveyance path. The alignment mechanism 42 beforehand detects the skewing and sliding amounts of the bills by an inspection line sensor, and determines a correction amount, thereby tilting the rollers to forcibly correct the bills.

The alignment mechanism 42 obtains a large effect, when the mechanism is disposed in a portion where the apparatus is most influenced by the positional shifts of the conveyance belts. For example, in the present embodiment, the alignment mechanism is provided at a position before the bills P are fed to the loading storage 32 and before the bills are fed to the strapping module 60*a* as shown in FIG. 2. In consequence, the fed bills P aligned along the conveyance path 44 by the alignment mechanism 42 are conveyed to the loading storage 32, and the aligned bills are accumulated in the loading storage 32. In consequence, the bills can advantageously be aligned and accumulated for the next withdrawal. Moreover, the bills P aligned along the conveyance path 44 by the alignment mechanism 42 are conveyed to and strapped in the strapping module 60*a*. When the alignment mechanism 42 establishes a positional relation between the bills to be strapped, the bills can neatly be accumulated and strapped by the strapping module.

As shown in FIG. 1 and FIG. 2, the strapping module 60*a* as an accumulation strapping device includes a conveyance path 62 which communicates with the conveyance path 44*a* of the loading module 30, a first accumulation device 64*a* and a second accumulation device 64*b* which accumulate the bills conveyed through the conveyance path 62 every predetermined number thereof, and a strapping device 68 which straps, with a tape, each bundle of the predetermined number of, for example, 100 bills accumulated by these accumulation devices. The second accumulation device 64*b* is disposed to obliquely shift from the first accumulation device 64*a* in a downward direction, and the strapping device 68 is disposed under the second accumulation device 64*b*. Furthermore, a discharge section 75 which receives and accumulates the bundles of the bills strapped by the strapping device 68 is disposed under the strapping device 68.

Each of the first and second accumulation devices 64*a* and 64*b* includes a temporary accumulating section 65, and an impeller accumulation device 66 which accumulates the predetermined number of the conveyed bills P one by one in the temporary accumulating section 65. An impeller 66*a* of the impeller accumulation device 66 has a plurality of blades incorporated around a rotary shaft, and is rotated synchronously with the conveyance of the bills so that each conveyed bill P is received between the blades. By using the impeller 66*a*, the bills are accumulated in the temporary accumulating section 65 while absorbing movement energy of the bills P conveyed at a high speed and while aligning the bills P.

The strapping module 60*a* includes a conveyance tray 70 which is movable in rising/lowering and traverse directions to receive the accumulated bills from the first and second accumulation devices 64*a* and 64*b*, respectively, thereby conveying the bills to the strapping device 68.

The strapping device 68 includes a tape supply section 71 which supplies a binding tape (a first tape) B for strapping the bundle of 100 bills conveyed via the conveyance tray 70, a printing device 72 which prints desirable information on the supplied binding tape, a tape winding mechanism 73 which winds a printed binding tape B1 around the bill bundle, and a regulation mechanism 76 which regulates a winding position of the binding tape B1 around the bill bundle.

As the printing device 72, an ink jet printer, a dot printer, a laser printer or the like can be used. The printing device 72 prints, on the binding tape B1, arbitrary information input by the operator, or the operator ID, date/time, serial number, assigned information, bank logo, manager signature image and the like stored in the memory 12*b*, with an arbitrary language font under the control of the main control unit 12 and the sub-control unit 61*a*.

Figure 15A:
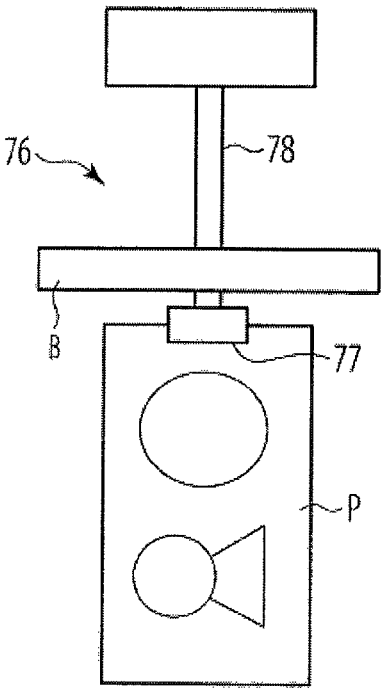
Figure 15B:
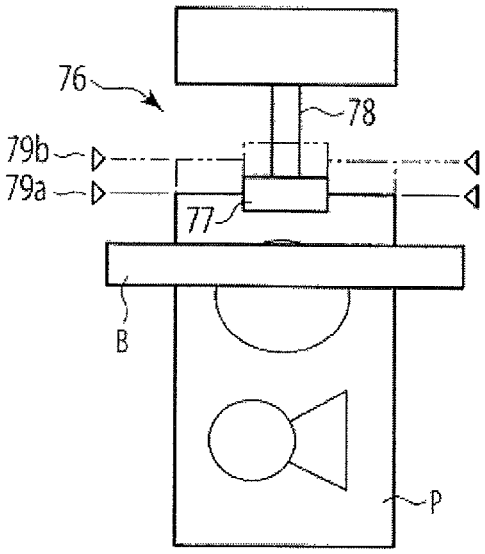

As shown in FIGS. 15A and 15B, the regulation mechanism 76 includes a chuck 77 which grasps the end of each bill bundle, a plunger 78 which reciprocates and moves the chuck 77 along a longitudinal direction of the bill bundle, and a plurality of position sensors 79*a* and 79*b* which detect a retracted position of the bill bundle. The regulation mechanism 76 grasps the bill bundle by the chuck 77, and retracts the bill bundle to an arbitrary position through the binding tape B1 wound in a loop state before bound, to regulate the winding position of the binding tape B1 around the bill bundle. For example, the position sensors 79*a* and 79*b* detect the retracted positions of the bill bundles, and these two positions can be regulated. In the present embodiment, the winding position of the binding tape B1 is regulated at a position which shifts from a large tape (a second tape) which binds a plurality of bill bundles.

Figure 16:
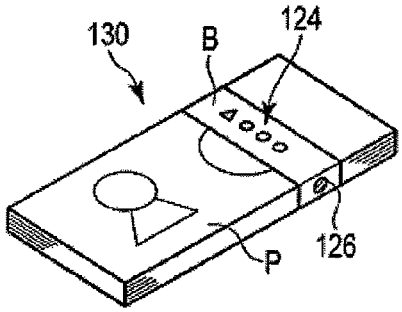
FIG. 16 is a perspective view showing a bound bill bundle (a small bundle)

FIG. 16 shows a bundle (a small bundle) 130 of 100 bills strapped by the strapping module 60*a*. The binding tape B1 is wound around the arbitrary position, and desirable information 124 is printed on the binding tape B1. Furthermore, an operator's confirmation seal 126 may be impressed on a side surface portion of the binding tape B1, i.e., a portion of the bill bundle 130 extending in a thickness direction.

As shown in FIG. 2, the bill bundles 130 accumulated and strapped as described above are discharged to the discharge section 75, and successively stacked and received. As described above, the strapping module 60*a* straps new notes fed from the main module 10 or new notes taken out of the loading storage 32 and fed from the loading module 30 for each money type every predetermined number thereof, to supply the sealed bill bundles.

As shown in FIG. 2, the strapping module 60*a* may include a large-bundle strapping device 115 which stacks a plurality of bill bundles 130 received in the discharge section 75 and binds the bundles with a large tape to form a large bill bundle. As shown in FIG. 17, the large-bundle strapping device 115 stacks a plurality of, for example, ten bill bundles 130, and binds the bundles with a plurality of binding tapes (second tapes) B2, to form a large bundle 140.

Figure 17A:
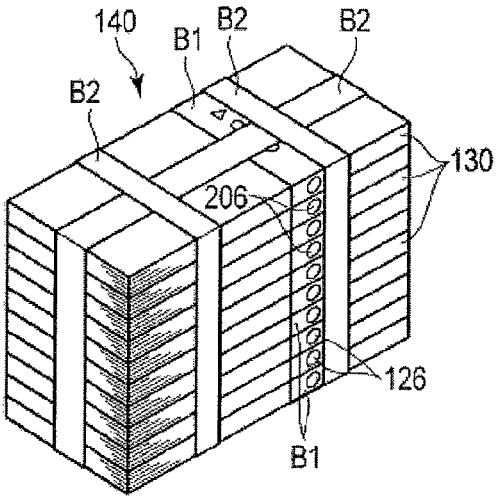
FIG. 17A is a perspective view showing a large bill bundle obtained by stacking and binding a plurality of small bundles.
Figure 17B:
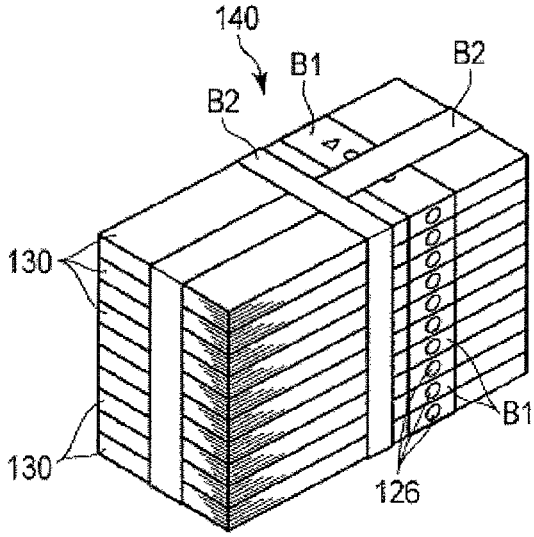
FIG. 17B is a perspective view showing another large bill bundle obtained by stacking and binding the plurality of small bundles.

The large bundle 140 shown in FIG. 17A is bound with one binding tape B2 in the longitudinal direction and with two binding tapes B2 in a lateral direction. The large bundle 140 shown in FIG. 17B is bound with one binding tape B2 in the longitudinal direction and with one binding tape B2 in the lateral direction. In each of the large bundles 140, the binding tape B1 of each of the small bundles 130 is wound around a position which shifts from the binding tape B2 of the large bundle 140, i.e., the position which does not overlap with the binding tape B2. Therefore, in the large bundle 140, a side surface portion of the binding tape B1 of each of the small bundles 130 does not hide behind the binding tape B2 but is exposed on the outer surface of the large bundle. In consequence, after forming the large bundle 140, the confirmation seal 126 can be impressed on the side surface portion of the binding tape B1 of each of the small bundles 130. Alternatively, even when the confirmation seal 126 is beforehand impressed on the side surface portion of the binding tape B1, the confirmation seal 126 can visually be checked from the outside after the large bundle 140 is formed.

According to the bill handling apparatus, ten small bundles prepared by the strapping module (ten small bundles) are collected and bound with the large tapes to strap the large bundle by the large-bundle strapping device, and the radio tag (RFID) in which the information from the bill handling apparatus is stored is attached to the large bundle, whereby the information may be linked between the bill handling apparatus and the large bundle.

As shown in FIG. 1, the other strapping modules 60*b* and 60*c* have a constitution which is similar to the strapping module 60*a*, and the conveyance paths 62 of the strapping modules 60*a*, 60*b* and 60*c* extend to communicate with one another. Moreover, the bills P are fed from the main module 10 or the loading module 30 to the arbitrary strapping module 60*a*, 60*b* or 60*c*, accumulated and strapped.

On the most downstream side of all the modules, a safety pocket 74 is provided. When there is a bill which cannot be processed during the conveyance through the respective modules, this bill is discharged to the safety pocket 74, and removed from the apparatus.

It is to be noted that after the handling, the loading storage 32 from or to which the bills are accumulated or resupplied by the bill handling apparatus as described above is removed from the loading module 30, and attached to the corresponding ATM.

Batch processing of a bill group by use of the batch card 116 is performed as follows.

For example, when a first stacked bill group (a first batch) and a second stacked bill group (a second batch) are processed, as shown in FIG. 2, the batch card (provided with the barcode) 116 is beforehand inserted into the rearmost end of each deposit batch. Additionally, a plurality of batches are stacked, and the stacked bill groups and the batch card are altogether set to the supply unit 11 of the handling apparatus, to perform continuous take-in.

As shown in FIG. 7, a characteristic number and the like of the bill group (the batch) is printed on the batch card 116 by the barcode 117, and the barcode can be read by the barcode reader provided in the conveyance path. The RGB sensor 23 is provided to face the mounting surface 11*b*, and the RGB sensor 23 detects the color of the paper sheets to detect the batch card 116. The barcode reader 19 reads the barcode 117 attached to the batch card 116 which has passed through the inspection device 18, and sends the read information to the main control unit 12. It is to be noted that any independent barcode reader is not provided but a constitution may be provided in which the inspection device 18 reads the barcode.

The inspection device 18 detects the passage of the batch card 116, and recognizes a boundary between the deposit batches to count the amount of the corresponding deposit money amount. The batch card 116 passes through the inspection device 18 and the barcode reader 19, and is fed to and accumulated in the rejecting section 20*a* or 20*b*. Consequently, the rejected bills rejected during the processing are accumulated between the batch card 116 of the belonging deposit batch and the batch card 116 of the immediately previous batch, and hence the belonging batch of each rejected bill can be identified. In the batch processing, the rejected bills can be resupplied to the supply unit 11 (mechanical recounting) after the first counting is completed.

The batch processing is constituted of two selectable types of a secure mode and a continuous mode.

In the secure continuous mode, the batch card is inserted into the rearmost end of the bill group, whereby continuous processing is performed without stopping processing operations among a plurality of batches if possible. After the batch card is detected, the take-in of the next batch is stopped until the counting is determined.

In the continuous mode, the batch card is inserted into the rearmost end of the bill group, whereby the continuous processing is performed without stopping the processing among the plurality of batches if possible. Even if the batch card is detected, the next take-in is not stopped.

Figure 18:
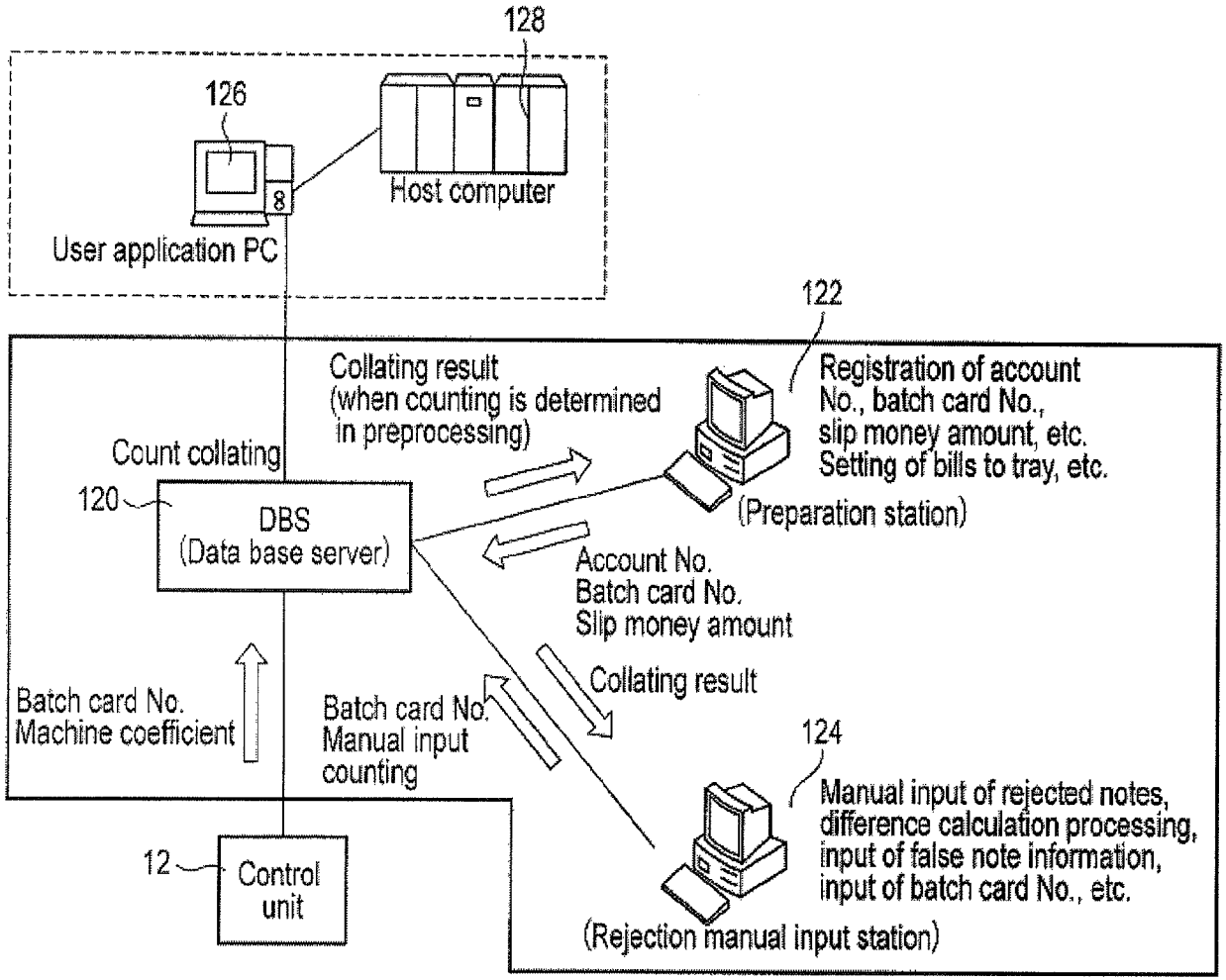
FIG. 18 is a diagram schematically showing an example of a batch card processing system.

FIG. 18 shows an example of a batch card system which manages the bill handling by use of the above data of the batch card. This system includes a database server 120, and a preparation station 122 and a rejection manual input station 124 connected to the database server. Moreover, the database server 120 is connected to a user application computer 126, and this computer is network-connected to a host computer 128. The batch card number and machine coefficient data are sent from the main control unit 12 of the bill handling apparatus to the database server.

The preparation station registers an account number, the batch card number and a slip money amount, sends these account number, batch card number and slip money amount to the database server, and instructs the loading of the bill group in the supply unit 11. The rejection manual input station performs the manual input of the information of the rejected notes, difference calculation processing, the input of the false note information, the manual input of the batch card number, and the like, and sends the input batch card number and a manual input coefficient to the database server.

The database server performs coefficient collating of the batch card number and machine coefficient data sent from the main control unit 12 of the bill handling apparatus, the account number, batch card number and slip money amount sent from the preparation station, and the batch card number and manual input coefficient input from the rejection manual input station, to send the collating results to the preparation station and the rejection manual input station. In consequence, it is monitored, in accordance with the batch card number, whether or not the mechanical counting of the bill group subjected to the batch processing is correctly performed.

On the other hand, when the jamming of the bills occurs in any step of the above bill handling, jam processing is performed as follows. The following requirement is incorporated in order to form burdens on the operator at the occurrence of the jamming.

At the occurrence of the jamming, the conveyance of the bills is not stopped in a portion where the conveyance can be continued among the accumulation storages 22*a* to 22*d* of the main module 10 and the strapping modules 60*a*, 60*b* and 60*c*, and the conveyance up to the accumulation storage and strapping accumulation is completed. In the strapping modules, when the accumulation of 100 bills is completed, a strapping operation is performed. A shift mistake is regarded as the conveyance jamming of a portion where the jamming has occurred.

In the strapping module, when the bills which have entered the module can completely be conveyed to the strapping accumulation or can be accumulated in the strapping accumulation, and when the conveyance path of the strapping module on the downstream side can be operated for the bills to be conveyed to the strapping module on the downstream, the conveyance of all the bills is completed. When the number of the bills accumulated in the strapping accumulation section reaches 100, the strapping operation is performed, and then stopped. If there is even one bill that cannot completely be conveyed, the conveyance is immediately stopped, and the bills have to be brought back.

The bills accumulated in the strapping module are securely reflected in the coefficient. When the jamming occurs during the strapping conveyance, the strapping conveyance is immediately stopped. The strapping mechanism section completes the strapping operation, when the predetermined number of the bills or 100 bills are accumulated, and the section stops after discharging the bills. The completely strapped bills and discharged bills are reflected in the counting.

After the operator removes the remaining bills due to the jamming during the strapping conveyance, the bills in the strapping conveyance are automatically conveyed to the safety pocket by operator's teller operation, and the bills accumulated in the safety pocket and both the strapping accumulations are collected. When the jamming occurs outside the strapping conveyance, when the completion of the conveyance to the strapping accumulation is enabled and the strapping accumulation is enabled and when the conveyance path of the strapping module on the downstream side can be operated for the bills to be conveyed to the strapping module on the downstream side, the conveyance of all the bills is completed. When the number of the bills accumulated in the strapping accumulation section reaches 100, the strapping operation is performed, and then stopped. At this time, the conveyance timing of the bills after the occurrence of the jamming is checked. When the bills are conveyed for a time which is longer than an estimated time, it is judged that the jamming has occurred. In this case, the bills accumulated in the strapping accumulation are brought back.

If there is even one bill that cannot completely be conveyed, the conveyance path is immediately stopped, and the bills in the strapping module are brought back. If the accumulation cannot be performed, however, the strapping conveyance is immediately stopped. After a cause for the jamming is removed, the remaining bills in the strapping conveyance are automatically conveyed to the strapping accumulation by the operator's teller operation, and the bills accumulated in both the strapping accumulations are collected.

In order to decrease the operator's operation after the jamming processing, the remaining bills may automatically be discharged. In this case, the operator performs the jamming processing of the portion where the conveyance jamming has occurred. Afterward, while the remaining bills are left in the conveyance path, the bills are conveyed at a usual speed, and accumulated in any of the rejection storage, the accumulation storage and the safety pocket. In this case, all the bills accumulated in the temporary storage are brought back. The operation is performed by the operator's teller operation after the cancellation of the jamming. An operation of opening the door of the portion where the conveyance jamming has occurred and monitoring the conveyance is performed during the conveyance so that a trouble such as the detaching of the conveyance belts does not occur.

According to the bill handling apparatus having the above constitution, the loading storage 32 removed from the ATM is attached to the attaching section 34 of the loading module 30, whereby the bills in the loading storage can automatically be taken and arranged in the bill handling apparatus. Moreover, when the bills taken out of the loading storage 32 are passed through the inspection device 38, the note types, the authenticities, the wearing states and the like can be judged. When the bills are returned to the loading storage, the present amount in the loading storage can be detected. That is, it is possible to perform inspection processing of inspecting the bills in the loading storage 32 and returning the bills to the loading storage again. When the bills taken out of the loading storage 32 are fed to the strapping modules 60*a* to 60*c*, a small bundle of 100 bills can be subjected to the strapping processing. Furthermore, when the loading storage 32 of the automatic teller machine has a loading function, the loading storage 32 is set to the bill handling apparatus, whereby the desirable number of the bills of the desirable note type introduced into the main module 10 can automatically be loaded in the loading storage. Moreover, various types of processing can be performed without opening the lid of the loading storage 32, and hence the security properties can be enhanced. The loading storage 32 can receive and transmit the information from and to the bill handling apparatus, and the present amount can bidirectionally be managed. Furthermore, a journal printer to print and output a transaction journal is provided in the loading module 30 if necessary, and this transaction journal may be attached to the loading storage 32.

When the loading storage 32 attached to the loading module 30 is a loading storage for exclusive use in withdrawal, the bills cannot directly be loaded in the loading storage by the pick up loading mechanism. In this case, the loading module 30 is provided with a temporary accumulating section which accumulates the bills taken out of the loading storage or the bills fed from the main module 10, and a robot hand which grasps, for example, 500 bills accumulated in this temporary accumulating section to load the bills in the loading storage 32, whereby loading processing can be performed.

Since the supply unit 11 of the main module 10 is provided to tilt from the vertical direction, the friction between the mounted stacked bills is lowered, and it is possible to prevent the slippage, the dragging of additional sheets, the pick up of double sheets, or the like during the pick up of the bills. In consequence, even when a large amount of bills are stacked and arranged, the bills can stably be taken out and handled one by one, which can enhance reliability. Moreover, since the supply unit 11 is provided at a comparatively low position in the apparatus main body, the loading operation of the paper sheets in the supply unit 11 can easily be performed.

Furthermore, even when the foreign matters are taken in, the foreign matters can be discharged and removed before carried into the inspection device, whereby it is possible to prevent the damage of the inspection device due to the foreign matters and to enhance the reliability of the bill handling apparatus.

Next, bill handling apparatuses according to the other embodiments will be described.

Figure 19:
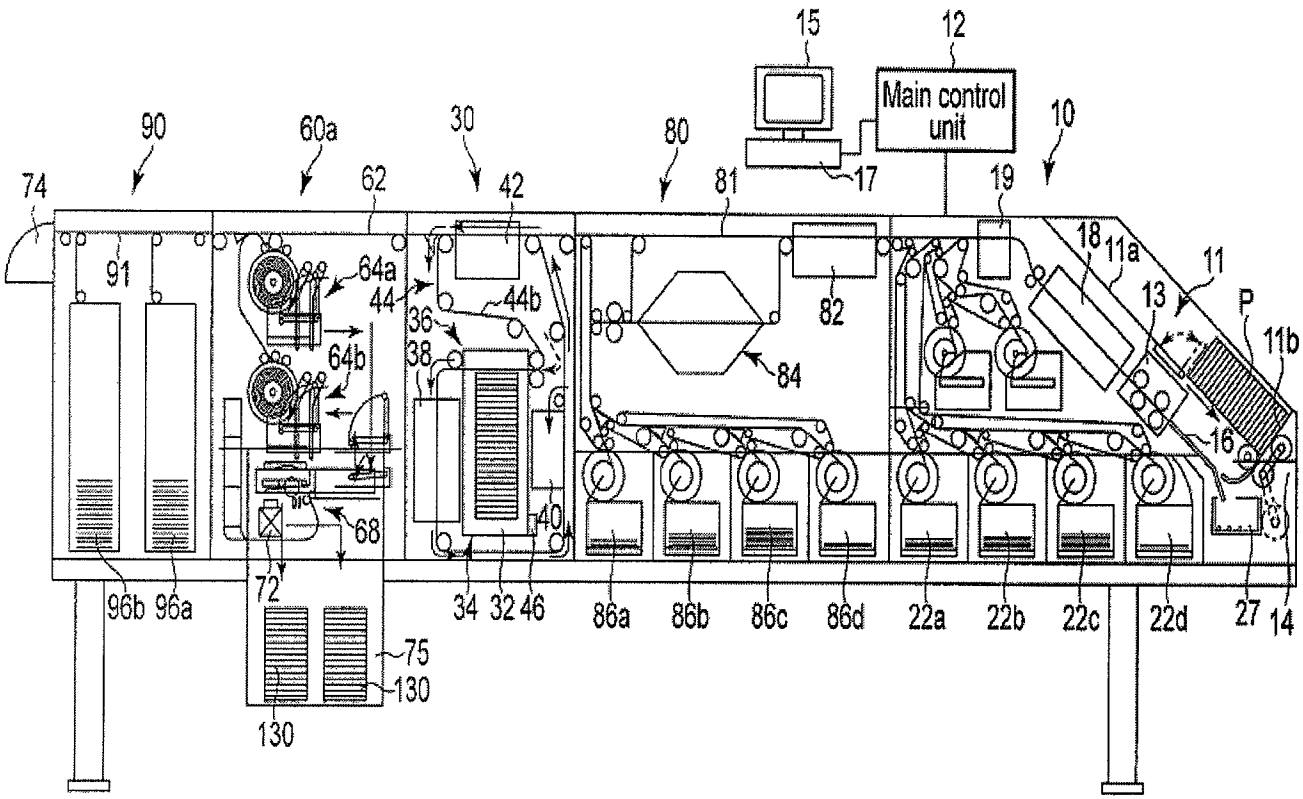
FIG. 19 is a sectional view showing a bill handling apparatus according to a second embodiment.

FIG. 19 shows the bill handling apparatus according to a second embodiment. As shown in this diagram, the bill handling apparatus includes a main module 10, an alignment module 80, a loading module 30, one strapping module 60*a* and a large-capacity accumulation module 90, and these modules are arranged side by side in one row in this order, and electrically and mechanically interconnected to one another. The main module 10 is provided with a main control unit 12 which controls an operation of the whole apparatus including this main module.

The main module 10, the loading module 30 and the strapping module 60*a* have a constitution which is similar to the first embodiment. The alignment module 80 interposed between the main module 10 and the loading module 30 includes a conveyance path 81 through which bills P fed from the main module 10 are conveyed, an alignment mechanism 82 provided on an upstream side of the conveyance path 81, an inverting device 84 provided on a downstream side of the alignment mechanism 82 along the conveyance path 81, and a plurality of accumulation storages 86*a*, 86*b*, 86*c* and 86*d* arranged side by side along the conveyance path 81.

The alignment mechanism 82 has a constitution which is similar to the alignment mechanism 42 of the loading module 30, and the mechanism aligns the center of each bill P conveyed through the conveyance path 81 with the center of the conveyance path, and corrects each skewed bill so that one side of the bill is directed orthogonally to a conveyance direction. The inverting device 84 inverts the bill P conveyed through the conveyance path 81, to align front surfaces, back surfaces, a forward direction and a rearward direction of the bills in arbitrarily designated directions, thereby feeding the bills.

Figure 20:
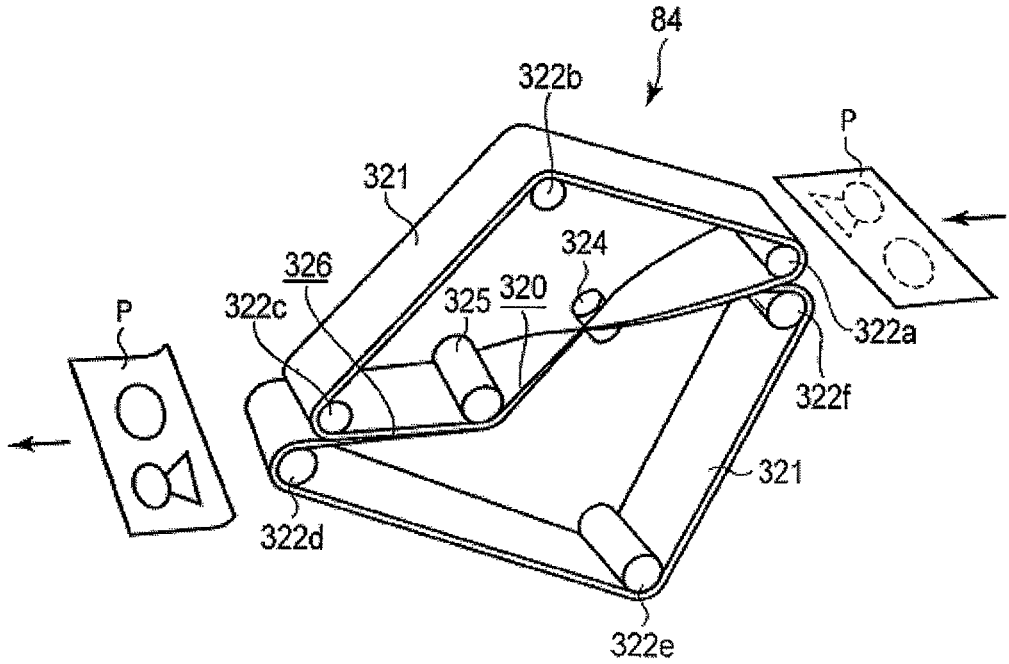
FIG. 20 is a perspective view showing an inverting device in the bill handling apparatus according to the second embodiment.
Figure 21:
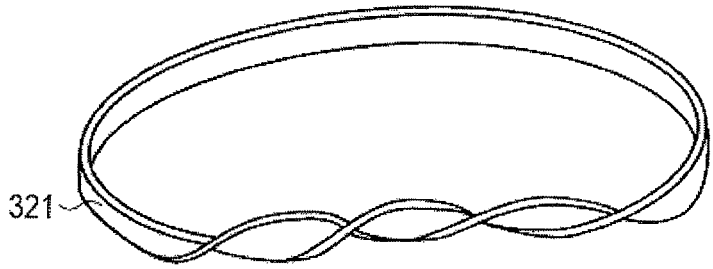
FIG. 21 is a perspective view showing a torsional belt of the inverting device.
Figure 22:
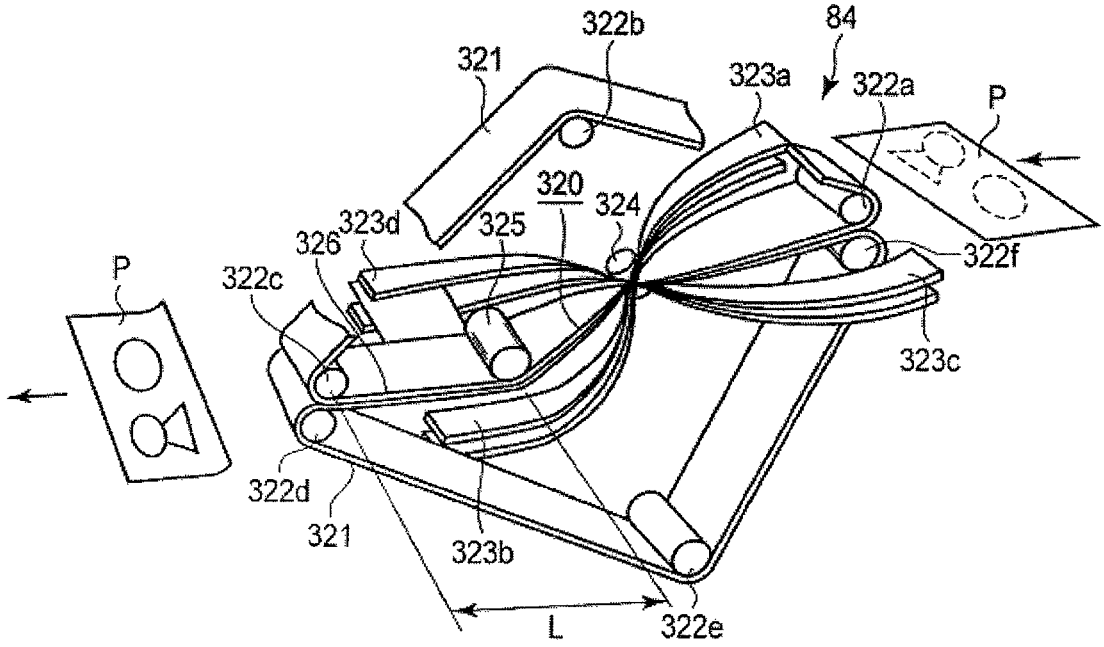
FIG. 22 is a perspective view showing the inverting device.

As shown in FIG. 20, the inverting device 84 includes a twisted conveyance path 320 twisted as much as 180 degrees, and as shown in FIG. 21, the twisted conveyance path 320 is formed by extending two endless belts (hereinafter referred to as the twisted belts) 321 twisted as much as 720 degrees and having stretching properties in an 8-shape via a plurality of rollers 322*a* to 322*f* and superimposing twisted portions on each other. Furthermore, as shown in FIG. 22, flat-plate-like twisted guide members 323*a*, 323*b*, 323*c* and 323*d* are arranged along both sides of the twisted conveyance path 320. These flat-plate-like twisted guide members are supported by supports (not shown), the guide members 323*a* and 323*b* and the guide members 323*c* and 323*d* form pairs, respectively, and the members are twisted in accordance with the twisted states of the twisted belts 321 via a kept space as shown. These twisted guides 323*a* to 323*d* are positioned on both sides of the twisted belts 321, and provided continuously from an inlet to an outlet of the twisted conveyance path 320.

The inverting device 84 includes an idler roller 324 provided in the center of each of the twisted belts 321, and this idler roller applies a holding force to the bills P. On the downstream side of the twisted conveyance path 320, a roller 325 for forming a horizontal conveyance path 326 is provided.

The bills P fed from the alignment mechanism 82 to the inverting device 84 pass through the twisted conveyance path 320 to invert the front and back surfaces of the bills, and the bills further pass through the horizontal conveyance path 326 so as to correct the twisted states thereof, and are discharged to the downstream side. In this case, both ends of the bills P in the longitudinal direction thereof are guided between the guide members 323*a* and 323*b* and between the guide members 323*c* and 323*d*, and hence four folds and a half fold can be prevented. Moreover, even when the bills P having low elasticity are inverted at a high speed, both the ends of the bills P are backed up by the twisted guides, and hence the generation of the fold or skew due to a wind pressure can be prevented.

As shown in FIG. 19, the bills P having the aligned directions and fed from the inverting device 84 are conveyed through the conveyance path 81 to the loading module 30 or fed to and accumulated in one of the accumulation storages 86*a* to 86*d*. Moreover, the bills P having the aligned directions and fed out of the loading module 30 are returned to the main module 10, and may be accumulated in accumulation storages 22*a* to 22*d* of the main module.

In bill loading processing in a loading storage 32, the bills P having the aligned directions and fed out of the inverting device 84 are conveyed through the conveyance path 81 to the loading module 30 and loaded in the loading storage 32. In this case, the inverting device 84 positively and alternately invert the front and back surfaces of the bills to feed out the bills, and the bills may be accumulated in the loading storage 32 so that the front and back surfaces of the bills are alternately arranged. In this case, the bills are prevented from being easily influenced by friction between the accumulated bills and depressed surfaces of the bills, whereby the bills can easily be taken out of the loading storage 32.

Moreover, the accumulation storages 86*a* to 86*d* of the alignment module 80 can be used as accumulation storages to accumulate the bills taken out of the loading storage 32 and sorted in accordance with each money type, or can be used as rejected note storage or worn note storage to accumulate rejected notes or worn notes taken out of the loading storage 32.

The large-capacity accumulation module 90 is connected to the downstream side of the strapping module 60*a*. The large-capacity accumulation module 90 includes a conveyance path 91 through which the bills P fed from the strapping module 60*a* are conveyed, and large-capacity accumulation storages 96*a* and 96*b* which can accumulate a predetermined amount of the bills conveyed through the conveyance path 91, respectively. When the predetermined amount of the bills are manually loaded in the loading storage 32, the beforehand set predetermined amount of the bills fed from the main module 10 or the loading storage 32 are accumulated in the accumulation storages 96*a* and 96*b*. Then, the accumulated bills are collectively taken out of the large-capacity accumulation storages 96*a* and 96*b*, and manually loaded in the loading storage 32. In consequence, the predetermined amount of the bills can easily be loaded in the loading storage 32.

According to the bill handling apparatus having the above constitution, the loading storage 32 can be subjected to various types of processing such as the collecting, loading and the like of the bills in the same manner as in the first embodiment. Moreover, since the alignment module 80 is provided, the bills having the arbitrarily set directions can be accumulated, loaded or strapped.

Figure 23:
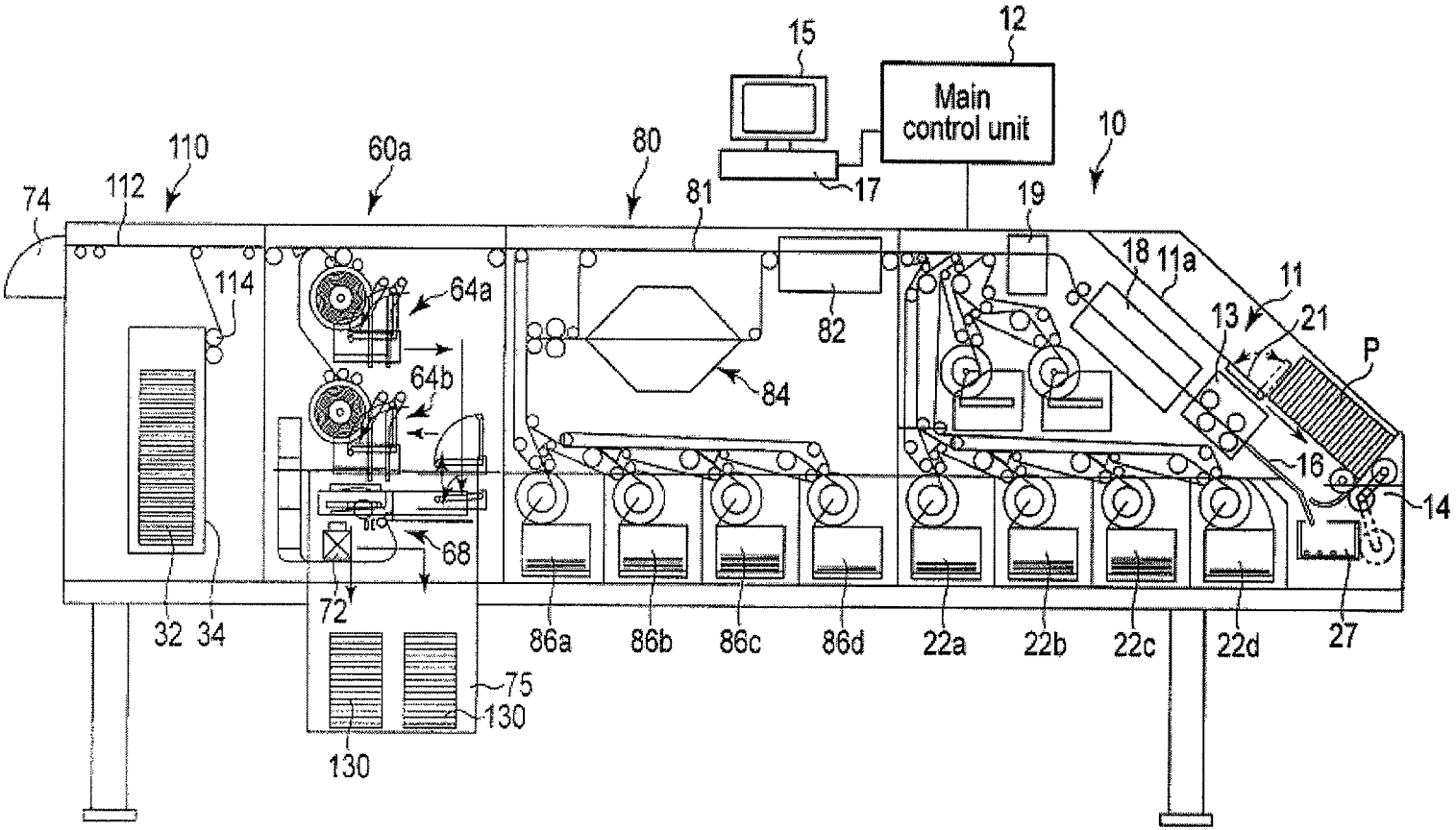
FIG. 23 is a sectional view showing a bill handling apparatus according to a third embodiment.

FIG. 23 shows a bill handling apparatus according to a third embodiment. According to the third embodiment, the bill handling apparatus includes a main module 10, an alignment module 80, one strapping module 60*a* and a loading module 110, and these modules are arranged side by side in one row in this order, and electrically and mechanically interconnected to one another. The main module 10 is provided with a main control unit 12 which controls an operation of the whole apparatus including this main module.

The main module 10, the alignment module 80 and the strapping module 60*a* have a constitution which is similar to the first and second embodiments. The loading module 110 connected to the downstream side of the strapping module 60*a* includes an attaching section 34 to which a loading storage of ATM for exclusive use in deposit or a loading storage which enables the deposit and withdrawal is detachably attached, a conveyance path 112 through which bills sent from a strapping module 60*a* side are conveyed, and a take-in mechanism 114 which loads the bills conveyed through the conveyance path 112 in a loading storage 32. Bills P supplied to the main module 10 are fed through the main module 10, the alignment module 80 and the strapping module 60*a* to the loading module 110, and loaded in the loading storage 32.

According to the bill handling apparatus having the above constitution, an inspection device 18 of the main module 10 inspects the bills P, and the bills can then be accumulated and strapped or loaded in the loading storage 32 for exclusive use in the deposit. Moreover, the bills can be supplied to and loaded in the loading storage 32 for exclusive use in the deposit. Additionally, a function and an effect which are similar to those of the first and second embodiments can be obtained also in the third embodiment.

Figure 24:
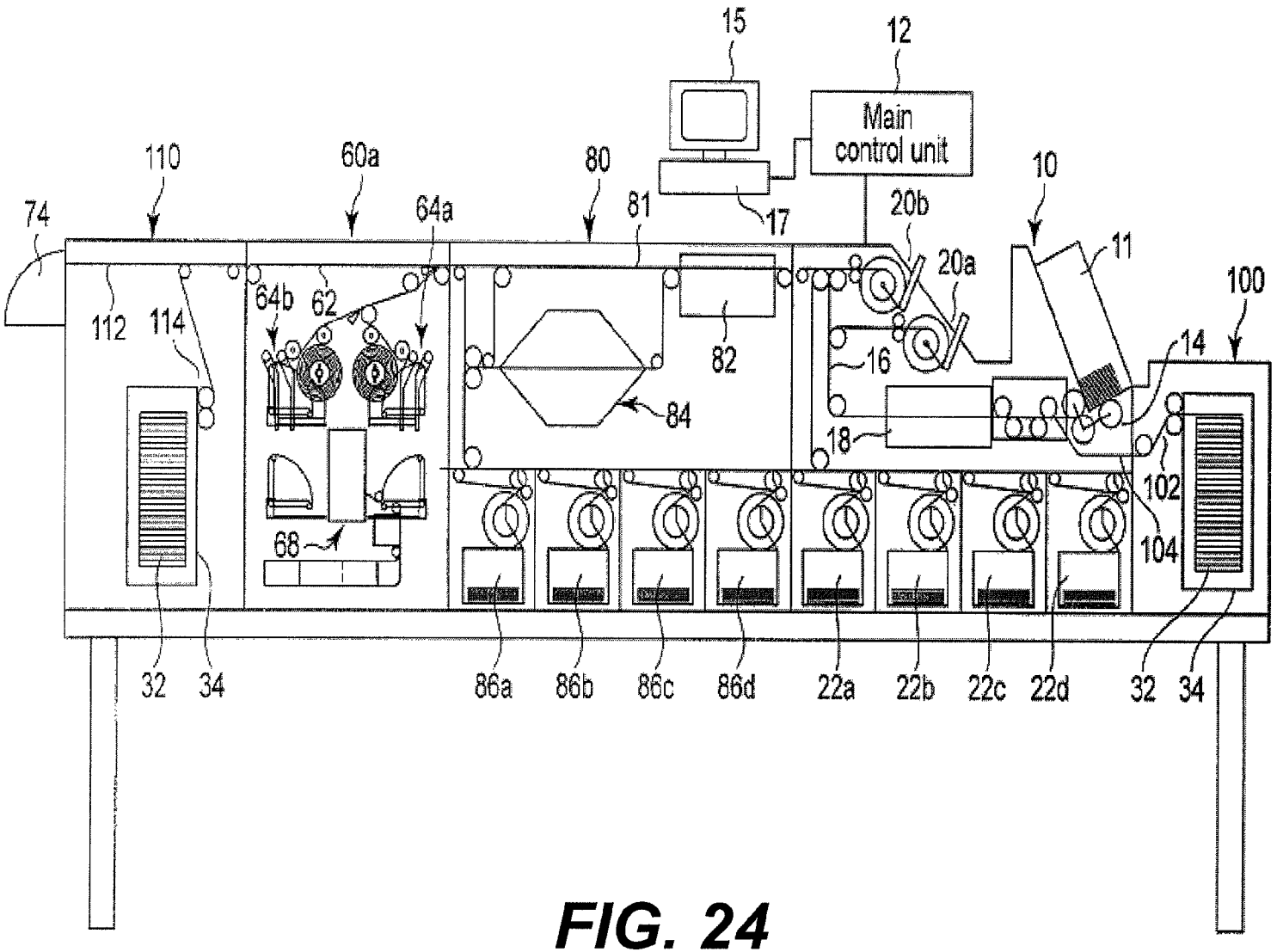
FIG. 24 is a sectional view showing a bill handling apparatus according to a fourth embodiment.

FIG. 24 shows a bill handling apparatus according to a fourth embodiment. According to the fourth embodiment, the bill handling apparatus includes a pick up module 100, a main module 10, an alignment module 80, one strapping module 60*a* and a loading module 110, and these modules are arranged side by side in one row in this order, and electrically and mechanically interconnected to one another. The main module 10 is provided with a main control unit 12 which controls an operation of the whole apparatus including this main module.

The main module 10, the alignment module 80, the strapping module 60*a* and the loading module 110 have a constitution which is similar to the first to third embodiments. The pick up module 100 provided on an upstream side of the main module 10 includes an attaching section 34 to which a loading storage of ATM for exclusive use in withdrawal or a loading storage which enables deposit and the withdrawal is detachably attached, a pick up mechanism 102 which picks up the bills from a loading storage 32, and a conveyance path through which the taken bills are conveyed. The conveyance path of the pick up module 100 communicates with a conveyance path 104 provided on the side of a pick up mechanism 14 of the main module 10. The bills taken out of the loading storage 32 are conveyed through the conveyance path 104 of the main module 10 to an inspection device 18. After inspection, new notes and worn notes are accumulated in accumulation storages 22*a* to 22*d*, or fed through the alignment module to the strapping module 60*a* or the loading module 110.

The loading module 110 connected to the downstream side of the strapping module 60*a* includes an attaching section 34 to which a loading storage of ATM for exclusive use in deposit or a loading storage which enables the deposit and the withdrawal is detachably attached, a conveyance path 112 through which bills sent from a strapping module 60*a* side are conveyed, and a take-in mechanism 114 which loads the bills conveyed through the conveyance path 112 in a loading storage 32. The bills supplied to the main module 10 or the bills taken out of the loading storage 32 by the pick up module 100 are fed through the main module 10, the alignment module 80 and the strapping module 60*a* to the loading module 110, and loaded in the loading storage 32.

According to the bill handling apparatus having the above constitution, the bills are taken out of the loading storage 32 for exclusive use in the withdrawal, are inspected by the inspection device 18 of the main module 10, and can be accumulated and strapped or loaded in the loading storage for exclusive use in the deposit. Moreover, the bills can be resupplied to and loaded in the loading storage for exclusive use in the deposit.

Figure 25:
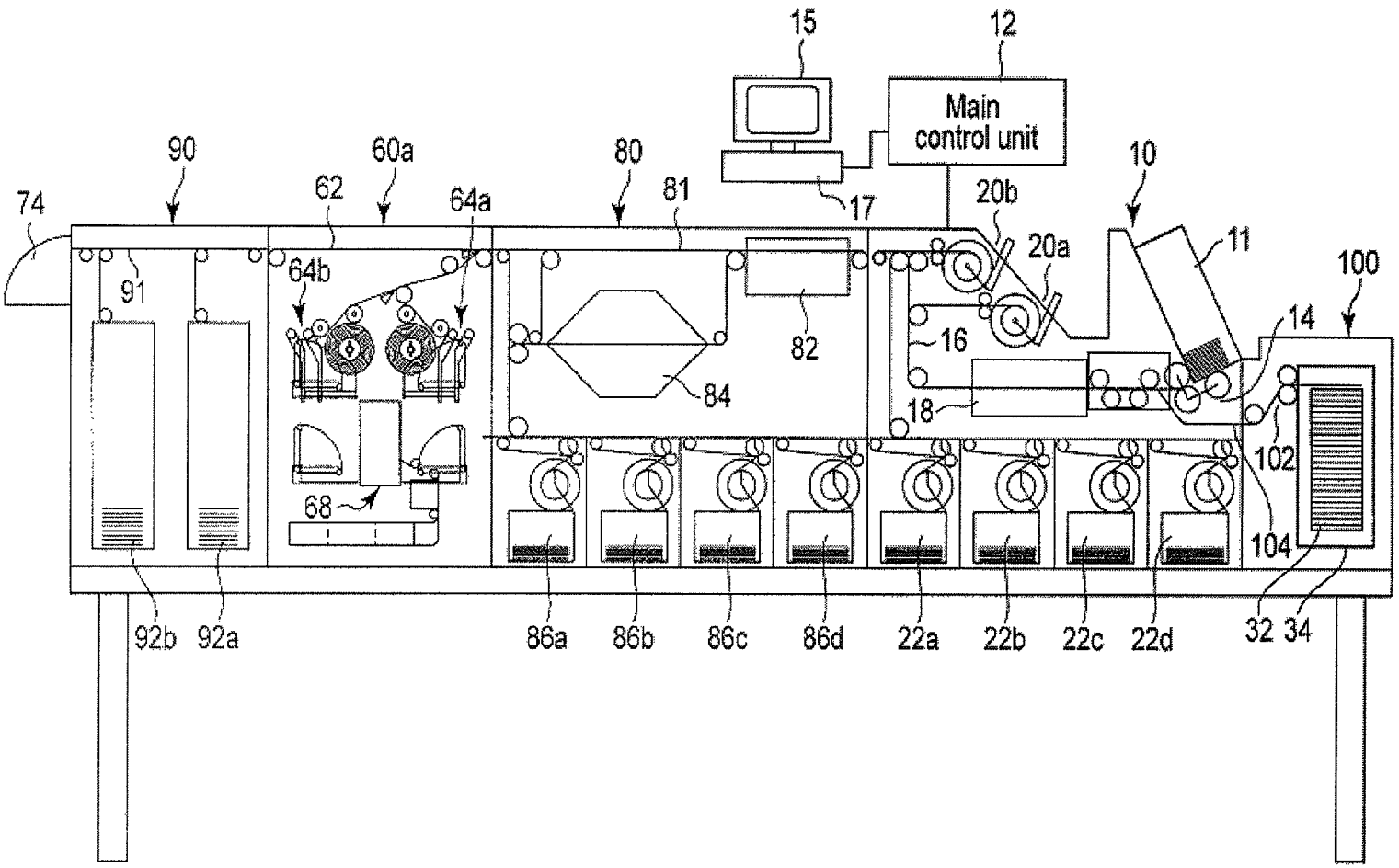
FIG. 25 is a sectional view showing a bill handling apparatus according to a fifth embodiment.

FIG. 25 shows a bill handling apparatus according to a fifth embodiment. According to the fifth embodiment, the bill handling apparatus includes a pick up module 100, a main module 10, an alignment module 80, one strapping module 60*a* and a large-capacity accumulation module 90, and these modules are arranged side by side in one row in this order, and electrically and mechanically interconnected to one another. The main module 10 is provided with a main control unit 12 which controls an operation of the whole apparatus including this main module.

The pick up module 100, the main module 10, the alignment module 80 and the strapping module 60*a* have a constitution which is similar to the fourth embodiment. The large-capacity accumulation module 90 has a constitution which is similar to the second embodiment.

According to the bill handling apparatus having the above constitution, bills taken out of a loading storage 32 by the pick up module 100 are conveyed through a conveyance path 104 of the main module 10 to an inspection device 18. After inspection, new notes and worn notes are accumulated in accumulation storages 22*a* to 22*d*, or fed through the alignment module 80 to the strapping module 60*a* or the large-capacity accumulation module 90.

When a predetermined amount of the bills are manually loaded in the loading storage 32, the beforehand set predetermined amount of the bills fed from the main module 10 or the bills taken out of the loading storage 32 are accumulated in accumulation storages 92*a* and 92*b*, respectively. Then, the accumulated bills are collectively taken out of the large-capacity accumulation storages 92*a* and 92*b*, and manually loaded in the loading storage 32. In consequence, the predetermined amount of the bills can easily be loaded in the loading storage 32.

In the above embodiments, there has been described the constitution in which a plurality of modules of the bill handling apparatus are arranged side by side in one row, but the present invention is not limited to this constitution, and the plurality of modules may be arranged side by side in an L-shape or a U-shape.

Figure 26:
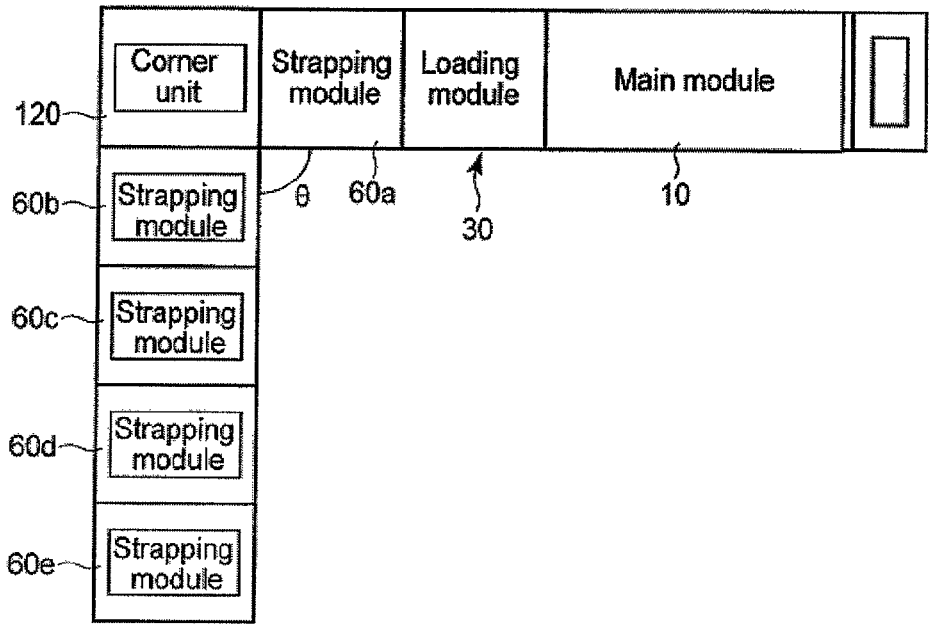
FIG. 26 is a plan view schematically showing a bill handling apparatus according to a sixth embodiment.

According to a sixth embodiment as shown in FIG. 26, a main module 10, a loading module 30 and a strapping module 60*a* are arranged side by side, and further via a corner unit 120, four strapping modules 60*b*, 60*c*, 60*d* and 60*e* are arranged side by side in a row, and arranged side by side in a direction which is substantially orthogonal to the row of the main module 10, the loading module 30 and the strapping module 60*a*. In consequence, the plurality of modules are arranged side by side in an L-shape. A constitution of each module is the same as that of the above first to fourth embodiments. The corner unit 120 includes a conveyance path through which bills are conveyed, and a rotation mechanism which rotates the bills from a substantially horizontal state to a vertical state, thereby enabling the bills to move along a corner. An inner angle θ of the corner of the module arrangement is set to a range, for example, from 45 to 135 degrees.

Figure 27:
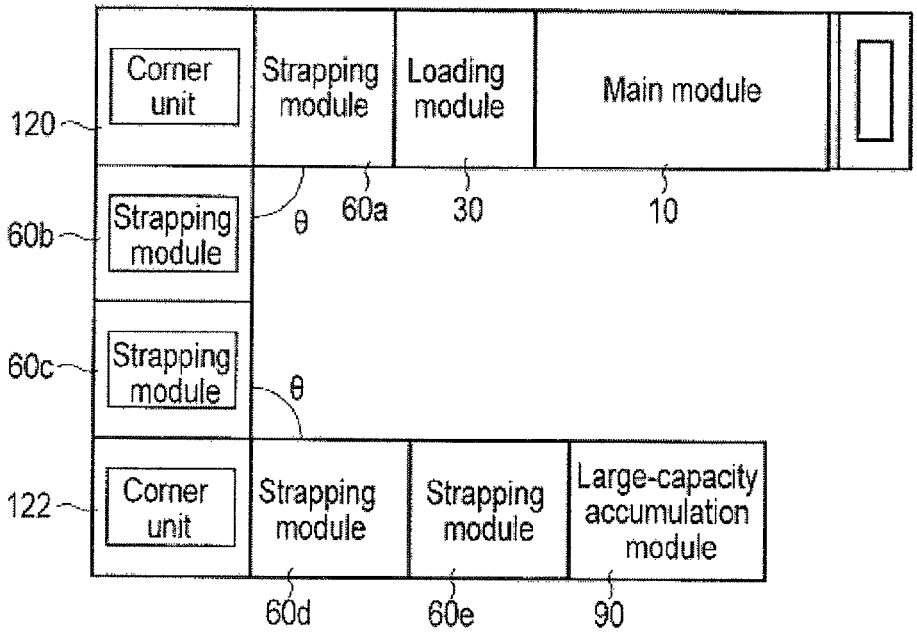
FIG. 27 is a plan view schematically showing a bill handling apparatus according to a seventh embodiment.

According to a seventh embodiment as shown in FIG. 27, a main module 10, a loading module 30 and a strapping module 60*a* are arranged side by side in a row, and further via a corner unit 120, two strapping modules 60*b* and 60*c* are arranged side by side in a row, and arranged side by side in a direction which is substantially orthogonal to the row of the main module 10, the loading module 30 and the strapping module 60*a*. Furthermore, via a corner unit 122, two strapping modules 60*d* and 60*e* and a large-capacity accumulation module 90 are arranged side by side in a row, and arranged side by side in a direction which is substantially orthogonal to the row of the strapping modules 60*b* and 60*c*. In consequence, the plurality of modules are arranged side by side in a U-shape. A constitution of each module is the same as that of the above first to fourth embodiments. Each of the corner units 120 and 122 includes a conveyance path through which bills are conveyed, and a rotation mechanism which rotates the bills from a substantially horizontal state to a vertical state, thereby enabling the bills to move along a corner. Inner angles θ of two corners of the module arrangement are set to a range, for example, from 45 to 135 degrees, respectively.

According to the sixth and seventh embodiments, even when the bill handling apparatus includes a large number of modules, the plurality of modules are arranged side by side in the L-shape or the U-shape, whereby the plurality of modules can be arranged comparatively closer to one another, and operability can be enhanced.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, in the first to seventh embodiments, the number of the modules to be connected is not limited to the embodiments, the number can be increased or decreased if necessary, and the types of the modules can variously be selected.

According to the above plurality of embodiments, it is possible to provide a paper sheet handling apparatus which can stably take out and handle loaded paper sheets and has an enhanced reliability.

The paper sheets to be handled are not limited to bills and batch cards, and may be applied to paper sheets such as casino cards and securities.

What is claimed is:

1. A paper sheet handling apparatus comprising:

a supply unit comprising a support surface which tilts from a vertical direction, and a mounting surface substantially perpendicular to the support surface, and configured to receive a plurality of paper sheets which tilt along the support surface and are stacked on the mounting surface;

a pick up mechanism configured to pick up the paper sheets from a mounting surface side of the supply unit;

a conveyance path configured to convey the picked up paper sheet;

an inspection device configured to inspect the conveyed paper sheet and arranged above the pick up mechanism in the vertical direction; and an accumulation unit configured to accumulate the inspected paper sheets, wherein the conveyance path tilts from the pick up mechanism to the inspection device obliquely from the vertical direction and extends upward from the pick up mechanism along the support surface, and the inspection device obliquely tilts and is provided under the support surface along the conveyance path.

2. The paper sheet handling apparatus according to claim 1, wherein the support surface of the supply unit tilts in a range of 25 to 75 degrees from the vertical direction.

3. The paper sheet handling apparatus according to claim 1, further comprising a collecting section provided under a lowermost portion of the conveyance path and configured to collect foreign matters, wherein the conveyance path comprises a discharge port through which foreign matters picked up in the conveyance path are discharged to the collecting unit.

4. The paper sheet handling apparatus according to claim 1, wherein the pick up mechanism comprises a pick up roller configured to pick up a lowermost paper sheet in the paper sheets mounted on the supply unit, and a control unit configured to regulate a pick up speed of the pick up mechanism in a plurality of steps.

5. The paper sheet handling apparatus according to claim 4, wherein the control unit is configured to temporarily stop or reverse the pick up roller, when the inspection device detects the pick up of two paper sheets or a short pitch between the paper sheets.

6. The paper sheet handling apparatus according to claim 1, further comprising:

an accumulation strapping device configured to accumulate and strap the paper sheets fed from the inspection device, the accumulation strapping device comprising:

a first strapping device configured to accumulate the paper sheets every predetermined number thereof and strap the accumulated paper sheets with a first tape to form a small bundle, and a second strapping device configured to accumulate a plurality of small bundles and strap the small bundles with a second tape to form a large bundle, and the first strapping device includes a regulation mechanism configured to change a retracted position of the bundle to regulate a winding position of the first tape to a position which shifts from the second tape.

7. The paper sheet handling apparatus according to claim 6, further comprising:

a printing device configured to print information on the first tape of the strapped small bundle; and the control unit is configured to store information including an operator ID, a date/time, a serial number, assignment information, a bank logo, a manager signature image and each country language font, and configured to supply the printing device with a printing information on the first tapes.

8. The paper sheet handling apparatus according to claim 1, further comprising:

a display device configured to display information including handled states; and a control device configured to calculate and store management information including a processing efficiency of a unit time, a processing efficiency of each of a plurality of days, a processing efficiency of each operator ID, a total number of the handled paper sheets and a total operation time in accordance with inspection information from the inspection device, and configured to display the management information in the display device.

9. The paper sheet handling apparatus according to claim 1, wherein the paper sheets mounted on the supply unit include a colored batch card provided with a barcode indicating information of a batch and stacked on a final step of a predetermined batch of the paper sheets, the apparatus further comprising:

a color sensor configured to detect the color of the batch card; a barcode reader configured to read the barcode of the batch card; and a batch card accumulation unit configured to accumulates the batch card passed through the inspection device.

10. A paper sheet handling apparatus comprising:

a main module comprising a supply unit comprising a support surface which tilts from a vertical direction, and a mounting surface substantially perpendicular to the support surface, and configured to receive a plurality of paper sheets which tilt along the support surface and are stacked on the mounting surface; a pick up mechanism configured to pick up the paper sheets from a mounting surface side of the supply unit; a conveyance path configured to convey the picked up paper sheet; an inspection device configured to inspect the conveyed paper sheet and arranged above the pick up mechanism in the vertical direction; and an accumulation unit configured to accumulate the inspected paper sheets, wherein the conveyance path tilts from the pick up mechanism to the inspection device obliquely from the vertical direction and extends upward from the pick up mechanism along the support surface, and the inspection device obliquely tilts and is provided along the conveyance path under the support surface; and a strapping module comprising an accumulation strapping device connected to the main module and configured to accumulate and strap the paper sheets fed from the main module every predetermined number thereof.

11. The paper sheet handling apparatus according to claim 10, further comprising:

an alignment module connected between the main module and the strapping module, and comprising a conveyance path communicating with the conveyance path of the main module to convey the paper sheets, and an inverting device configured to invert the paper sheets passing through the conveyance path.

12. The paper sheet handling apparatus according to claim 10, further comprising:

a loading module connected to the main module and comprising an attaching section to which a loading storage of an automatic teller machine is detachably attached; a conveyance path communicating with the main module and configured to convey the paper sheets; a loading pick up mechanism configured to load and pick up the paper sheets in and from the loading storage; an inspection device configured to inspect the paper sheets picked up from the loading storage; and a rejection storage configured to accumulate a rejected paper sheet in the inspected paper sheets, to load the paper sheets fed from the main module in the loading storage.

13. A paper sheet handling apparatus comprising:

a supply unit comprising a support surface which tilts from a vertical direction, and a mounting surface substantially perpendicular to the support surface, and configured to receive a plurality of paper sheets which tilt along the support surface and are stacked on the mounting surface;

a pick up mechanism configured to pick up the paper sheets from a mounting surface side of the supply unit;

a conveyance path configured to convey the picked up paper sheet;

a collecting section provided under a lowermost portion of the conveyance path and configured to collect foreign matters;

an inspection device configured to inspect the conveyed paper sheet and arranged above the pick up mechanism in the vertical direction; and an accumulation unit configured to accumulate the inspected paper sheets;

wherein the conveyance path tilts from the pick up mechanism to the inspection device obliquely from the vertical direction and extends upward from the pick up mechanism, and the conveyance path comprises a discharge port through which foreign matters picked up in the conveyance path are discharged to the collecting section.

* * * * *